US012247775B2

(12) United States Patent
Kim et al.

(10) Patent No.: US 12,247,775 B2
(45) Date of Patent: Mar. 11, 2025

(54) REFRIGERATOR

(71) Applicant: LG ELECTRONICS INC., Seoul (KR)

(72) Inventors: Seokhyun Kim, Seoul (KR); Sangoh Kim, Seoul (KR); Junseong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 615 days.

(21) Appl. No.: 17/600,266

(22) PCT Filed: Apr. 1, 2020

(86) PCT No.: PCT/KR2020/004448
§ 371 (c)(1),
(2) Date: Sep. 30, 2021

(87) PCT Pub. No.: WO2020/204595
PCT Pub. Date: Oct. 8, 2020

(65) Prior Publication Data

US 2022/0163251 A1 May 26, 2022

(30) Foreign Application Priority Data

Apr. 1, 2019 (KR) ..... 10-2019-0037970

(51) Int. Cl.
*F25D 21/02* (2006.01)
*F25D 21/08* (2006.01)
*F25D 29/00* (2006.01)

(52) U.S. Cl.
CPC ..... *F25D 21/02* (2013.01); *F25D 21/08* (2013.01); *F25D 29/00* (2013.01);
(Continued)

(58) Field of Classification Search
CPC ..... F25D 21/06; F25D 21/08; F25D 2600/02; F25D 21/02; F25D 2600/06; F25D 2700/10; F25D 2700/12; F25D 29/00; H05B 6/50
See application file for complete search history.

(56) References Cited

U.S. PATENT DOCUMENTS 8,424,324 B2 * 4/2013 Petrenko ..... F25D 21/08 62/154
8,931,296 B2 * 1/2015 Petrenko ..... H05B 3/42 62/276
(Continued)

FOREIGN PATENT DOCUMENTS

CN 103868310 A 6/2014
CN 108050767 A 5/2018
(Continued)

OTHER PUBLICATIONS

Translation of DE 3818491.*
Translation of KR 20050011575.*

*Primary Examiner* — Filip Zec
(74) *Attorney, Agent, or Firm* — BRYAN CAVE LEIGHTON PAISNER LLP

(57) ABSTRACT

The present disclosure relates to a refrigerator. The refrigerator according to an embodiment of the present disclosure includes: a compressor configured to compress a refrigerant; an evaporator configured to perform heat exchange using the refrigerant compressed by the compressor; an RF output device configured to output an RF signal to the evaporator for removing frost on the evaporator; and a controller configured to control the RF output device, wherein the controller is configured to: based on the RF signal, control the frost to phase change into a liquid by heat radiated from a plurality of metal fins of the evaporator; and after the phase change, control temperature of the phase changed liquid to
(Continued)

increase by a water molecule movement based on the RF signal. Accordingly, defrosting may be performed using the RF signal.

20 Claims, 22 Drawing Sheets

(52) U.S. Cl.
CPC ..... *F25D 2600/02* (2013.01); *F25D 2600/06* (2013.01); *F25D 2700/10* (2013.01); *F25D 2700/12* (2013.01)

(56) References Cited

U.S. PATENT DOCUMENTS

| | | | | |
|---|---|---|---|---|
| 9,095,167 | B2 * | 8/2015 | Lee | A23L 3/26 |
| 9,638,455 | B2 * | 5/2017 | Kim | F25D 21/08 |
| 10,501,972 | B2 * | 12/2019 | Twiggar, III | E05D 7/00 |
| 11,384,975 | B2 * | 7/2022 | Kim | F25D 21/00 |
| 2002/0092849 | A1 | 7/2002 | Petrenko | |
| 2003/0046942 | A1 * | 3/2003 | Shedivy | F25C 1/12 62/353 |
| 2004/0011067 | A1 * | 1/2004 | Park | F25D 29/00 62/206 |
| 2005/0086955 | A1 * | 4/2005 | Rafalovich | F25D 21/006 62/156 |
| 2007/0101753 | A1 * | 5/2007 | Broadbent | F25B 39/02 62/349 |
| 2009/0254220 | A1 * | 10/2009 | Shin | F25D 11/02 62/157 |
| 2019/0101325 | A1 * | 4/2019 | Piel | H05B 6/62 |
| 2020/0109891 | A1 * | 4/2020 | Xu | H05B 6/62 |
| 2020/0120765 | A1 * | 4/2020 | Xu | H05B 6/72 |

FOREIGN PATENT DOCUMENTS

| | | | |
|---|---|---|---|
| CN | 108759177 | A | 11/2018 |
| CN | 109000408 | A | 12/2018 |
| CN | 110906635 | A | 3/2020 |
| DE | 3818491 | A1 | 12/1989 |
| EP | 2741032 | A2 | 6/2014 |
| JP | HO0064081 | U | 9/1994 |
| JP | H09-250863 | A | 9/1997 |
| JP | 2000-121233 | A | 4/2000 |
| JP | 2004-212001 | A | 7/2004 |
| JP | 2011012935 | A | 1/2011 |
| KR | 10-2005-0011575 | A | 1/2005 |
| KR | 10-2014-0074653 | A | 6/2014 |
| KR | 10-2017-0132966 | A | 12/2017 |

* cited by examiner

REFRIGERATOR

This application is a National Stage filing under 35 U.S.C. 371 of International Application No. PCT/KR2020/004448, filed Apr. 1, 2020, which claims the benefit of Korean Patent Application No. 10-2019-0037970, filed Apr. 1, 2019, the contents of which are all hereby incorporated by reference herein in their entirety.

BACKGROUND

1. Field of the Invention

The present disclosure relates to a refrigerator, and more particularly, to a refrigerator capable of performing a defrosting operation by using an RF signal.

2. Description of the Related Art

For long-term storage of foods in a refrigerator, a refrigerator temperature is reduced using a compressor and an evaporator. For example, a freezer compartment in the refrigerator is maintained at a temperature of approximately −18° C.

Meanwhile, in order to improve refrigerator performance, it is desirable to remove frost which may be on the evaporator when the evaporator operates.

Meanwhile, Korean Laid-Open Patent Publication No. 10-2005-011575 discloses a method of removing frost on a refrigerator evaporator by attaching a heater wire, coated on an insulation film, to the evaporator.

The method has a problem in that by the operation of the defrost heater wire, temperature of the defrost heater wire increases to approximately 100° C. or higher, such that hot air is introduced into a refrigerating chamber or a freezer chamber, thereby increasing, rather than decreasing, the temperature in the refrigerating chamber or the freezer chamber.

SUMMARY

It is an object of the present disclosure to provide a refrigerator capable of performing a defrosting operation by using an RF signal.

It is another object of the present disclosure to provide a refrigerator capable of performing a defrosting operation by using an RF signal while reducing heat generation.

In accordance with an aspect of the present disclosure, the above and other objects can be accomplished by providing a refrigerator, including: a compressor configured to compress a refrigerant; an evaporator configured to perform heat exchange using the refrigerant compressed by the compressor; an RF output device configured to output an RF signal to the evaporator for removing frost on the evaporator; and a controller configured to control the RF output device, wherein the controller is configured to: based on the RF signal, control the frost to phase change into a liquid by heat radiated from a plurality of metal fins of the evaporator; and after the phase change, control temperature of the phase changed liquid to increase by a water molecule movement based on the RF signal.

Meanwhile, by an operation of the RF output device, temperature of the plurality of metal fins of the evaporator may be preferably higher than temperature of the phase changed liquid near the metal fins.

Meanwhile, as a frequency of the RF signal increases, the heat radiated from a plurality of metal fins of the evaporator may increase.

Meanwhile, as a defrost section decreases, or as an amount of frost on the evaporator increases, or as a period of the defrost section increases, the controller may increase the frequency of the RF signal.

Meanwhile, as a number of the plurality of metal fins of the evaporator increases, or as a distance between the plurality of metal fins of the evaporator decreases, the heat radiated from the plurality of metal fins may increase.

Meanwhile, during at least the defrost section, the controller may output the RF signal to the evaporator.

Meanwhile, during a portion of a cooling section before defrost, an idle section following the cooling section before defrost, the defrost section, an idle section after defrost, and a portion of a cooling section after defrost, the controller may output the RF signal to the evaporator.

Meanwhile, during the operation of the RF output device, the controller may turn off the compressor.

Meanwhile, when a cooling section for operation of a refrigerating compartment or a freezer compartment starts after the operation of the RF output device, the controller may control the RF output device to stop outputting the RF signal.

Meanwhile, the controller may control the RF output device to be operated during an idle section and a defrost section following the idle section.

Meanwhile, the controller may control the RF output device to be further operated during a portion of a cooling section before defrost before the idle section.

Meanwhile, the controller may control the RF output device to be further operated during an idle section after defrost following the idle section and at least a portion of a cooling section after defrost following the idle section after defrost.

Meanwhile, the refrigerator may further include a fan configured to supply cold air generated by heat exchange in the evaporator into a freezer compartment.

Meanwhile, after stopping the operation of the RF output device during the cooling section after defrost, the controller may operate the fan.

Meanwhile, the controller may control a second idle section after defrost to perform after the fan is operated, and may control a second cooling section after defrost to perform after the second idle section after defrost, wherein during the second idle section after defrost and the second cooling section after defrost, the controller may continuously operate the fan.

Meanwhile, during a third idle section after defrost after the second cooling section after defrost, the controller may operate again the RF output device while turning off the compressor.

Meanwhile, the controller may continuously operate the fan during the third idle section after defrost.

Meanwhile, the controller may control power of the RF signal from the RF output device during the third idle section after defrost to be smaller than power of the RF signal during the defrost section.

Meanwhile, during a portion of the second cooling section after defrost, the controller may operate again the RF output device while turning off the compressor.

Meanwhile, during a portion of the second cooling section after defrost, the controller may continuously operate the fan.

Meanwhile, the controller may control power of the RF signal, output from the RF output device during a portion of the second cooling section after defrost, to be smaller than power of the RF signal during the defrost section.

Meanwhile, in response to a defrost end temperature of a freezer compartment or a refrigerating compartment in the RF output device being greater than or equal to a first temperature, or in response to a defrost period of the RF output device being greater than or equal to a first period, the controller may stop the operation of the RF output device.

Meanwhile, the refrigerator may further include a defrost heater, wherein after the operation of the RF output device, the controller may operate the defrost heater.

Meanwhile, the refrigerator may further include a frost sensor configured to detect an amount of frost on the evaporator, wherein during the operation of the RF output device, the controller may change at least one of an output period and output power of the RF signal according to the amount of the deposited frost.

Meanwhile, a frequency of the RF signal according to an embodiment of the present disclosure may be preferably between 13.56 MHz and 433 MHz.

Meanwhile, the RF output device may include: a first plate and a second plate; and a heat insulating material disposed on a surface opposite to at least one evaporator of the first plate and the second plate.

Meanwhile, at least one of the first plate and the second plate may be preferably disposed facing at least a lower portion of the evaporator.

Meanwhile, the RF output device may include at least one of: a power detector configured to detect power of the RF signal reflected from the evaporator; a temperature detector configured to detect temperature of the evaporator; and a camera for photographing the evaporator.

Meanwhile, the controller may be configured to: output an RF signal of a first power during a scan section; and output an RF signal of a second power set based on an RF signal reflected from the evaporator during the scan section.

Meanwhile, the refrigerator according to an embodiment of the present disclosure may further include: a fan configured to supply cold air generated by heat exchange in the evaporator into a freezer compartment; and a second RF output device disposed in a cavity of the freezer compartment and configured to output a second RF signal.

In accordance with another aspect of the present disclosure, the above and other objects can be accomplished by providing a refrigerator, including: a compressor configured to compress a refrigerant; an evaporator configured to perform heat exchange using the refrigerant compressed by the compressor; an RF output device configured to output an RF signal to the evaporator for removing frost on the evaporator; and a controller configured to control the RF output device, wherein the controller is configured to output the RF signal to the evaporator during at least a defrost section, wherein during an operation of the RF output device, temperature of a plurality of metal fins of the evaporator is higher than temperature of the frost formed on the metal fins.

In accordance with yet another aspect of the present disclosure, the above and other objects can be accomplished by providing a refrigerator, including: a compressor configured to compress a refrigerant; an evaporator configured to perform heat exchange using the refrigerant compressed by the compressor; an RF output device configured to output an RF signal to the evaporator; and a controller configured to control the RF output device, wherein the controller is configured to, by outputting the RF signal, perform a first period in which temperature of a liquid near the evaporator decreases, and a second period in which the temperature of the liquid increases after the first period and is maintained within a predetermined range, wherein during an operation of the RF output device, temperature of a plurality of metal fins of the evaporator is higher than temperature of other regions of the evaporator.

Effects of the Invention

A refrigerator according to an embodiment of the present disclosure includes: a compressor configured to compress a refrigerant; an evaporator configured to perform heat exchange using the refrigerant compressed by the compressor; an RF output device configured to output an RF signal to the evaporator for removing frost on the evaporator; and a controller configured to control the RF output device, wherein the controller is configured to: based on the RF signal, control the frost to phase change into a liquid by heat radiated from a plurality of metal fins of the evaporator; and after the phase change, control temperature of the phase changed liquid to increase by a water molecule movement based on the RF signal. Accordingly, defrosting may be performed using the RF signal. Particularly, defrosting may be performed while reducing heat generation.

Meanwhile, in the refrigerator according to an embodiment of the present disclosure, by an operation of the RF output device, temperature of the plurality of metal fins of the evaporator may be preferably higher than temperature of the phase changed liquid near the metal fins. Accordingly, defrosting may be performed using the RF signal, while reducing heat generation.

Meanwhile, in the refrigerator according to an embodiment of the present disclosure, as a frequency of the RF signal increases, the heat radiated from a plurality of metal fins of the evaporator may increase. Accordingly, defrosting may be performed using the RF signal, while reducing heat generation.

Meanwhile, as a defrost section decreases, or as an amount of frost on the evaporator increases, or as a period of the defrost section increases, the controller may increase the frequency of the RF signal. Accordingly, defrosting may be performed efficiently using the RF signal.

Meanwhile, in the refrigerator according to an embodiment of the present disclosure, as a number of the plurality of metal fins of the evaporator increases, or as a distance between the plurality of metal fins of the evaporator decreases, the heat radiated from the plurality of metal fins may increase. Accordingly, defrosting may be performed efficiently using the RF signal.

Meanwhile, during at least the defrost section, the controller may output the RF signal to the evaporator. Accordingly, defrosting may be performed efficiently using the RF signal.

Meanwhile, during a portion of a cooling section before defrost, an idle section following the cooling section before defrost, the defrost section, an idle section after defrost, and a portion of a cooling section after defrost, the controller may output the RF signal to the evaporator. Accordingly, defrosting may be performed stably using the RF signal.

Meanwhile, during the operation of the RF output device, the controller may turn off the compressor. Accordingly, defrosting may be performed using the RF signal while reducing power consumption.

Meanwhile, when a cooling section for operation of a refrigerating compartment or a freezer compartment starts after the operation of the RF output device, the controller may control the RF output device to stop outputting the RF signal. Accordingly, a cooling operation may be performed smoothly during the cooling section, and power consumption of the refrigerator may be reduced.

Meanwhile, the controller may control the RF output device to be operated during an idle section and a defrost section following the idle section. Accordingly, defrosting may be performed efficiently using the RF signal.

Meanwhile, the controller may control the RF output device to be further operated during a portion of a cooling section before defrost before the idle section. Accordingly, defrosting may be performed stably using the RF signal.

Meanwhile, the controller may control the RF output device to be further operated during an idle section after defrost following the idle section and at least a portion of a cooling section after defrost following the idle section after defrost. Accordingly, defrosting may be performed stably using the RF signal.

Meanwhile, the controller may operate a fan after stopping the operation of the RF output device during the cooling section after defrost. Accordingly, a cooling operation may be performed smoothly during the cooling section, and power consumption of the refrigerator may be reduced.

Meanwhile, the controller may control a second idle section after defrost to perform after the fan is operated, and may control a second cooling section after defrost to perform after the second idle section after defrost, wherein during the second idle section after defrost and the second cooling section after defrost, the controller may continuously operate the fan. Accordingly, a cooling operation may be performed smoothly during the cooling section, and power consumption of the refrigerator may be reduced.

Meanwhile, during a third idle section after defrost after the second cooling section after defrost, the controller may operate again the RF output device while turning off the compressor. Accordingly, a cooling operation may be performed smoothly using the RF signal, and power consumption of the refrigerator may be reduced.

Meanwhile, the controller may continuously operate the fan during the third idle section after defrost. Accordingly, cold air may be supplied continuously into the refrigerator.

Meanwhile, the controller may control power of the RF signal from the RF output device during the third idle section after defrost to be smaller than power of the RF signal during the defrost section. Accordingly, defrosting may be performed using the RF signal, while reducing power consumption.

Meanwhile, during a portion of the second cooling section after defrost, the controller may operate again the RF output device while turning off the compressor. Accordingly, defrosting may be performed using the RF signal, while reducing power consumption.

Meanwhile, during a portion of the second cooling section after defrost, the controller may continuously operate the fan. Accordingly, defrosting may be performed using the RF signal, while reducing power consumption.

Meanwhile, the controller may control power of the RF signal, output from the RF output device during a portion of the second cooling section after defrost, to be smaller than power of the RF signal during the defrost section. Accordingly, defrosting may be performed using the RF signal, while reducing power consumption.

Meanwhile, in response to a defrost end temperature of a freezer compartment or a refrigerating compartment in the RF output device being greater than or equal to a first temperature, or in response to a defrost period of the RF output device being greater than or equal to a first period, the controller may stop the operation of the RF output device. Accordingly, defrosting may be performed efficiently using the RF signal.

Meanwhile, the refrigerator may further include a defrost heater, wherein after the operation of the RF output device, the controller may operate the defrost heater. Accordingly, defrosting may be performed efficiently using the RF signal.

Meanwhile, the refrigerator may further include a frost sensor configured to detect an amount of frost on the evaporator, wherein during the operation of the RF output device, the controller may change at least one of an output period and output power of the RF signal according to the amount of the deposited frost. Accordingly, defrosting may be performed efficiently using the RF signal.

Meanwhile, a frequency of the RF signal according to an embodiment of the present disclosure may be preferably between 13.56 MHz and 433 MHz. Accordingly, defrosting may be performed efficiently using the RF signal.

Meanwhile, the RF output device may include: a first plate and a second plate; and a heat insulating material disposed on a surface opposite to at least one evaporator of the first plate and the second plate. Accordingly, defrosting may be performed efficiently using the RF signal.

Meanwhile, at least one of the first plate and the second plate may be preferably disposed facing at least a lower portion of the evaporator. Accordingly, defrosting may be performed efficiently using the RF signal.

Meanwhile, the RF output device may include at least one of: a power detector configured to detect power of the RF signal reflected from the evaporator; a temperature detector configured to detect temperature of the evaporator; and a camera for photographing the evaporator. Accordingly, defrosting may be performed efficiently using the RF signal.

Meanwhile, the controller may be configured to: output an RF signal of a first power during a scan section; and output an RF signal of a second power set based on an RF signal reflected from the evaporator during the scan section. Accordingly, defrosting may be performed efficiently using the RF signal.

Meanwhile, the refrigerator according to an embodiment of the present disclosure may further include: a fan configured to supply cold air generated by heat exchange in the evaporator into a freezer compartment; and a second RF output device disposed in a cavity of the freezer compartment and configured to output a second RF signal. Accordingly, freshness of goods in the cavity may be maintained using the RF signal.

Meanwhile, a refrigerator according to another embodiment of the present disclosure includes: a compressor configured to compress a refrigerant; an evaporator configured to perform heat exchange using the refrigerant compressed by the compressor; an RF output device configured to output an RF signal to the evaporator for removing frost on the evaporator; and a controller configured to control the RF output device, wherein the controller is configured to output the RF signal to the evaporator during at least a defrost section, wherein during an operation of the RF output device, temperature of a plurality of metal fins of the evaporator is higher than temperature of the frost formed on the metal fins. Accordingly, defrosting may be performed using the RF signal. Particularly, defrosting may be performed while reducing heat generation.

Meanwhile, a refrigerator according to yet another embodiment of the present disclosure includes: a compressor configured to compress a refrigerant; an evaporator configured to perform heat exchange using the refrigerant compressed by the compressor; an RF output device configured to output an RF signal to the evaporator; and a controller configured to control the RF output device, wherein the controller is configured to, by outputting the RF signal, perform a first period in which temperature of a liquid near the evaporator decreases, and a second period in which the temperature of the liquid increases after the first period and is maintained within a predetermined range, wherein during an operation of the RF output device, temperature of a plurality of metal fins of the evaporator is higher than temperature of other regions of the evaporator. Accordingly, defrosting may be performed using the RF signal. Particularly, defrosting may be performed while reducing heat generation.

DETAILED DESCRIPTION OF THE PREFERRED EMBODIMENTS

Hereinafter, the present disclosure will be described in further detail with reference to the accompanying drawings.

The suffixes "module" and "unit" in elements used in description below are given only in consideration of ease in preparation of the specification and do not have specific meanings or functions. Therefore, the suffixes "module" and "unit" may be used interchangeably.

Figure 1:
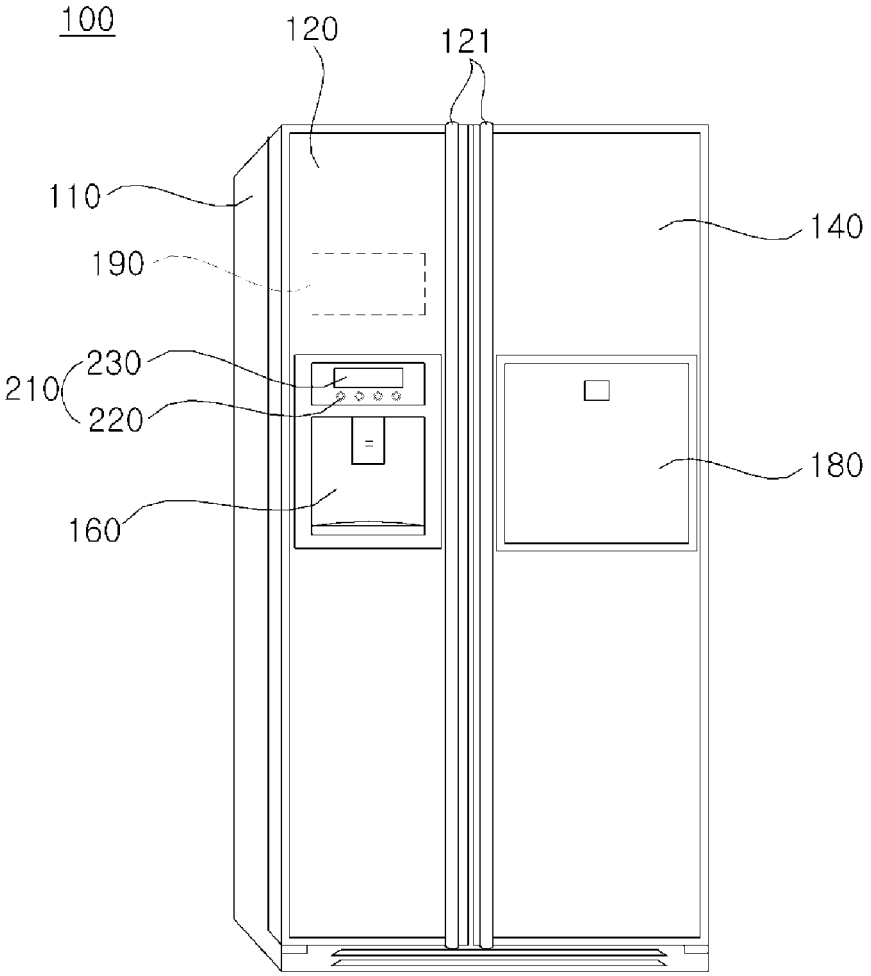
FIG. 1 is a perspective view illustrating a refrigerator according to an embodiment of the present invention.

FIG. 1 is a perspective view illustrating a refrigerator according to an embodiment of the present invention.

Referring to the drawings, a refrigerator 100 according to an embodiment of the present invention forms a rough outer shape by a case 110 having an internal space divided, although not shown, into a freezer compartment and a refrigerating compartment, a freezer compartment door 120 that shields the freezer compartment, and a refrigerator door 140 to shield the refrigerating compartment.

In addition, the front surface of the freezer compartment door 120 and the refrigerating compartment door 140 is further provided with a door handle 121 protruding forward, so that a user easily grips and rotates the freezer compartment door 120 and the refrigerating compartment door 140.

Meanwhile, the front surface of the refrigerating compartment door 140 may be further provided with a home bar 180 which is a convenient means for allowing a user to take out a storage such as a beverage contained therein without opening the refrigerating compartment door 140.

In addition, the front surface of the freezer compartment door 120 may be provided with a dispenser 160 which is a convenient means for allowing the user to easily take out ice or drinking water without opening the freezer compartment door 120, and a control panel 210 for controlling the driving operation of the refrigerator 100 and displaying the state of the refrigerator 100 being operated on a screen may be further provided in an upper side of the dispenser 160.

Meanwhile, in the drawing, it is illustrated that the dispenser 160 is disposed in the front surface of the freezer compartment door 120, but is not limited thereto, and may be disposed in the front surface of the refrigerating compartment door 140.

The control panel 210 may include an input device 220 formed of a plurality of buttons, and a display device 230 for displaying a control screen, an operation state, and the like.

The display device 230 displays information such as a control screen, an operation state, a temperature inside the refrigerator, and the like. For example, the display device 230 may display the set temperature of the freezer compartment and the set temperature of the refrigerating compartment.

The display device 230 may be implemented in various ways, such as a liquid crystal display (LCD), a light emitting diode (LED), an organic light emitting diode (OLED), and the like. In addition, the display device 230 may be implemented as a touch screen capable of serving as the input device 220.

The input device 220 may include a plurality of operation buttons. For example, the input device 220 may include a freezer compartment temperature setting button (not shown) for setting the freezer compartment temperature, and a refrigerating compartment temperature setting button (not shown) for setting the refrigerating compartment temperature. Meanwhile, the input device 220 may be implemented as a touch screen that may also function as the display device 230.

Meanwhile, the refrigerator according to an embodiment of the present disclosure is not limited to a double door type shown in the drawing, but may be a one door type, a sliding door type, a curtain door type, and the like regardless of its type.

Figure 2:
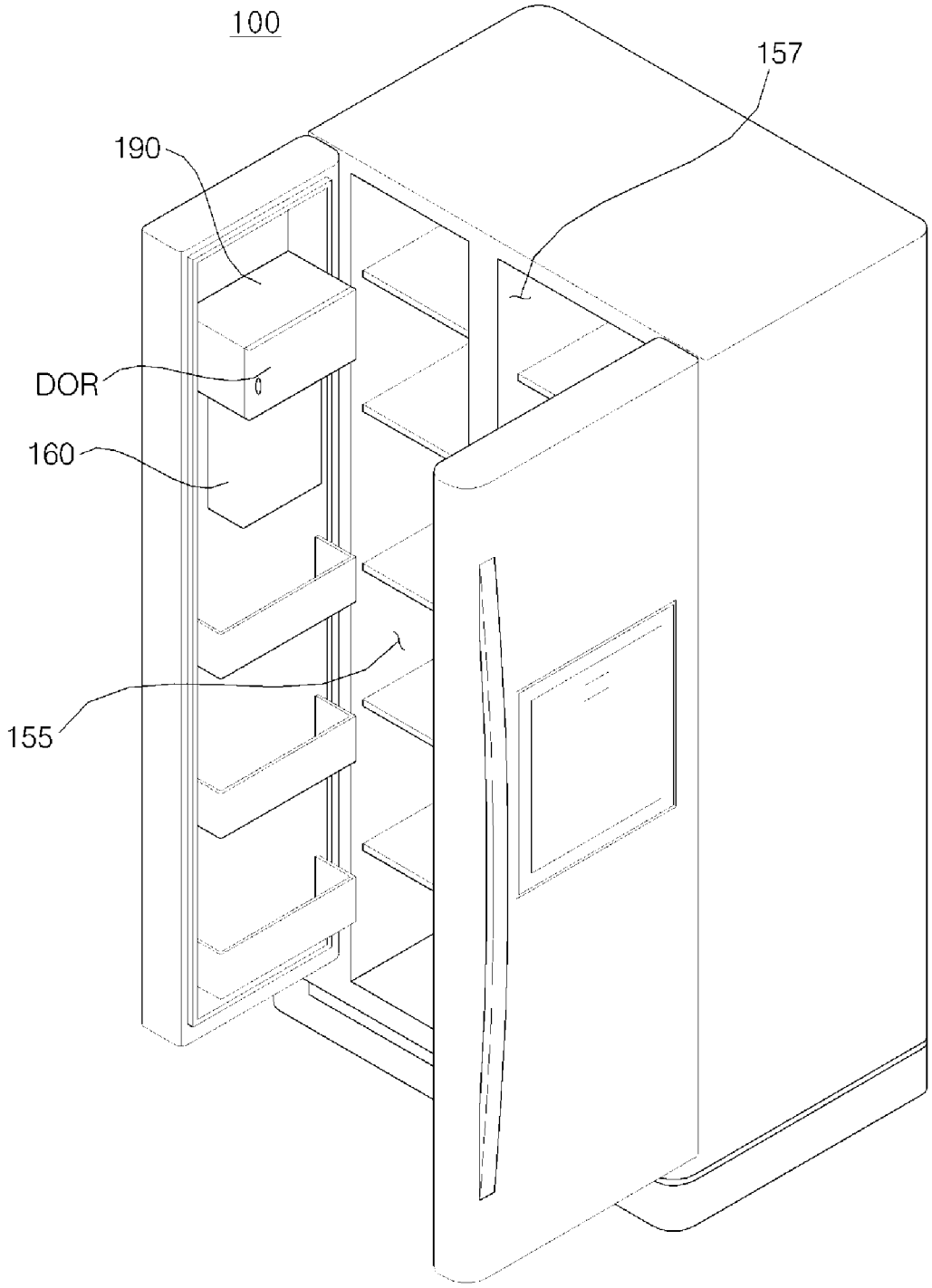
FIG. 2 is a perspective view of a door of the refrigerator of FIG. 1.

FIG. 2 is a perspective view of a door of the refrigerator of FIG. 1.

Referring to the drawing, a freezer compartment 155 is disposed inside the freezer compartment door 120, and a refrigerating compartment 157 is disposed inside the refrigerating compartment door 140.

An RF output device 190 may be disposed in the inner upper portion of the freezer compartment 155 to freeze the goods by using cold air in the freezer compartment while maintaining the freshness.

In the drawing, it is shown that the RF output device 190 is attached to the freezer compartment door 120, but the present disclosure is not limited thereto, and it is also possible that the RF output device 190 is disposed in a space inside the freezer compartment instead of the freezer compartment door 120.

Figure 3:
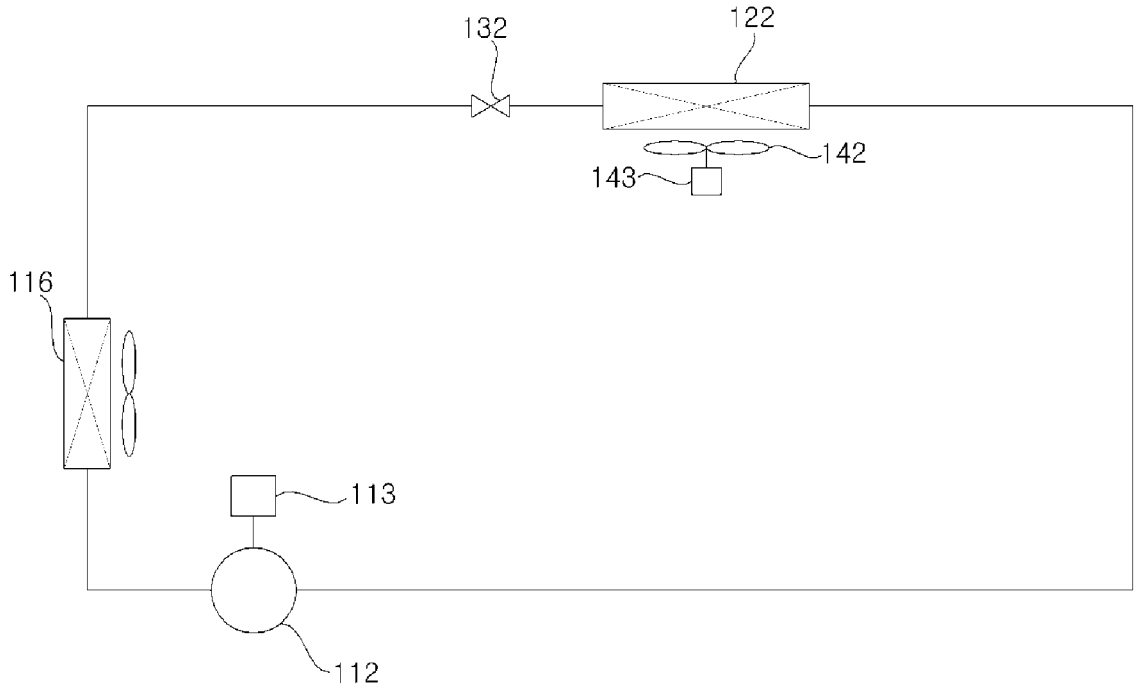
FIG. 3 is a view schematically illustrating a configuration of the refrigerator of FIG. 1.

FIG. 3 is a view schematically illustrating a configuration of the refrigerator of FIG. 1.

Referring to the drawing, the refrigerator 100 may include a compressor 112, a condenser 116 for condensing a refrigerant compressed by the compressor 112, a freezer compartment evaporator 122 which is supplied with the refrigerant condensed in the condenser 116 to evaporate, and is disposed in a freezer compartment (not shown), and a freezer compartment expansion valve 132 for expanding the refrigerant supplied to the freezer compartment evaporator 122.

Meanwhile, in the drawing, it illustrated that a single evaporator is used, but it is also possible to use respective evaporators may be used in the refrigerating compartment and the freezer compartment.

That is, the refrigerator 100 may further include a refrigerating compartment evaporator (not shown) disposed in a refrigerator compartment (not shown), a three-way valve (not shown) for supplying the refrigerant condensed in the condenser 116 to the refrigerating compartment evaporator (not shown) or the freezer compartment evaporator 122, and a refrigerating compartment expansion valve (not shown) for expanding the refrigerant supplied to the refrigerating compartment evaporator (not shown).

In addition, the refrigerator 100 may further include a gas-liquid separator (not shown) which separates the refrigerant passed through the evaporator 122 into a liquid and a gas.

In addition, the refrigerator 100 may further include a refrigerating compartment fan (not shown) and a freezer compartment fan 144 that suck cold air that passed through the freezer compartment evaporator 122 and blow the sucked cold air into a refrigerating compartment (not shown) and a freezer compartment (not shown) respectively.

In addition, the refrigerator 100 may further include a compressor driver 113 for driving the compressor 112, and a refrigerating compartment fan driver (not shown) and a freezer compartment fan driver 145 for driving the refrigerating compartment fan (not shown) and the freezer compartment 144.

Meanwhile, based on the drawing, since a common evaporator 122 is used for the refrigerating compartment and the freezer compartment, in this case, a damper (not shown) may be installed between the refrigerating compartment and the freezer compartment, and a fan (not shown) may forcibly blow the cold air generated in one evaporator to be supplied to the freezer compartment and the refrigerating compartment.

Figure 4:
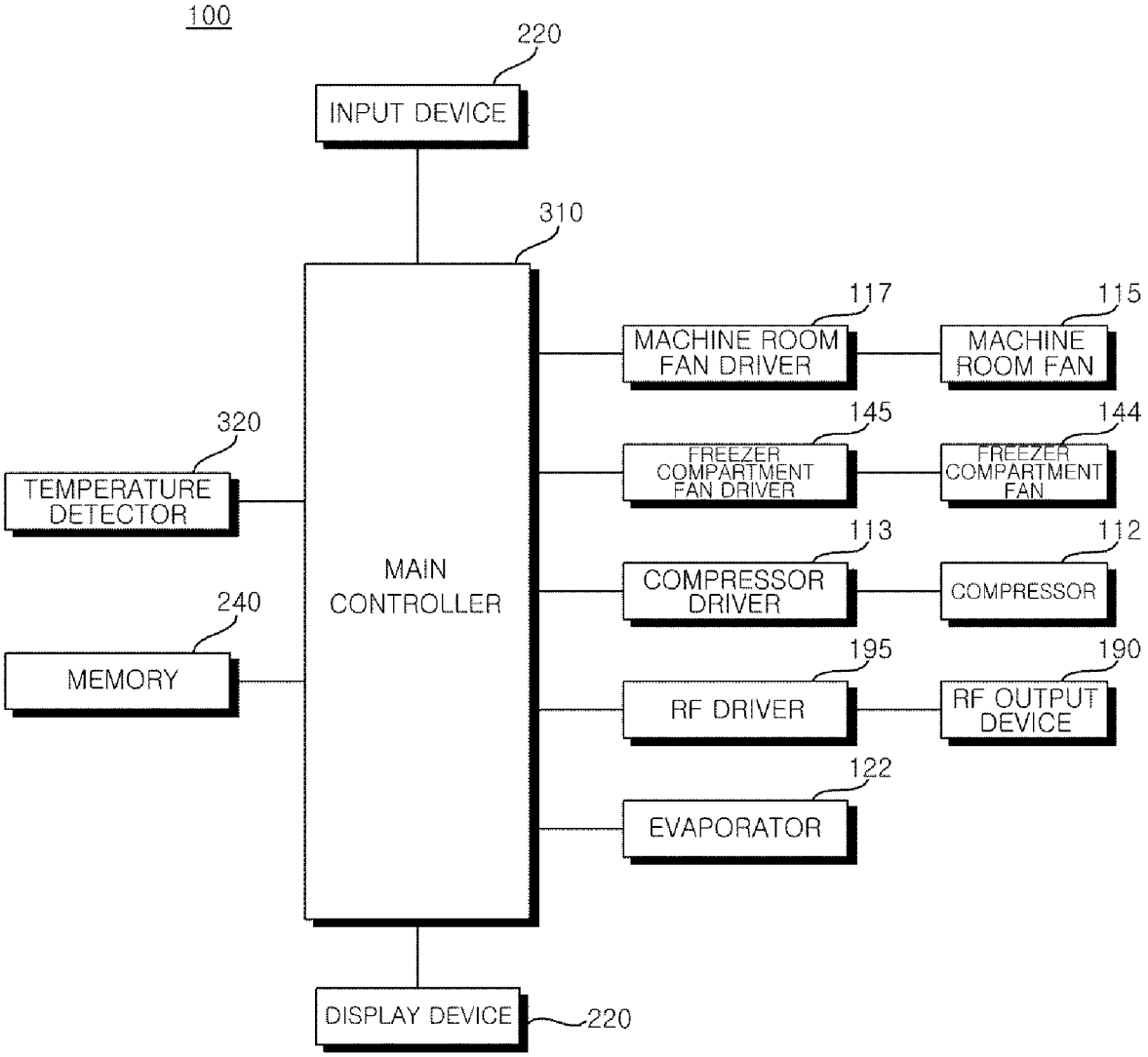
FIG. 4 is a block diagram schematically illustrating the inside of the refrigerator shown in FIG. 1.

FIG. 4 is a block diagram schematically illustrating the inside of the refrigerator shown in FIG. 1.

Referring to the drawing, the refrigerator of FIG. 4 includes a compressor 112, a machine room fan 115, a freezer compartment fan 144, a main controller 310, a heater 330, an RF output device 190, an RF driver 195, a temperature detector 320, and a memory 240. In addition, the refrigerator may further include a compressor driver 113, a machine room fan driver 117, a freezer compartment fan driver 145, a heater driver 332, an RF driver 195, an RF output device 190, a display device 230, and an input device 220.

The compressor 112, the machine room fan 115, and the freezer compartment fan 144 are described with reference to FIG. 2.

The input device 220 includes a plurality of operation buttons, and transmits a signal for an input freezer compartment set temperature or refrigerating compartment set temperature to the main controller 310.

The display device 230 may display an operation state of the refrigerator. Meanwhile, the display device 230 is operable under the control of a display controller (not shown).

The memory 240 may store data necessary for operating the refrigerator.

For example, the memory 240 may store power consumption information for each of the plurality of power consumption devices. In addition, the memory 240 may output corresponding power consumption information to the main controller 310 based on the operation of each power consumption device in the refrigerator.

The temperature detector 320 detects a temperature in the refrigerator and transmits a signal for the detected temperature to the main controller 310. Here, the temperature detector 320 detects the refrigerating compartment temperature and the freezer compartment temperature respectively. In addition, the temperature of each chamber in the refrigerating compartment or each chamber in the freezer compartment may be detected.

As shown in the drawing, in order to control the on/off operation of the compressor 112, the fan 115 or 144, and the RF output device 190, the main controller 310 may control the compressor driver 113, the fan driver 117 or 145, and the RF driver 195 to finally control the compressor 112, the fan 115 or 144, and the RF output device 190. Here, the fan driver may be the machine room fan driver 117 or the freezer compartment fan driver 145.

For example, the main controller 310 may output a corresponding speed command value signal to the compressor driver 113 or the fan driver 117 or 145 respectively.

The compressor driver 113 and the freezer compartment fan driver 145 described above are provided with a compressor motor (not shown) and a freezer compartment fan motor (not shown) respectively, and each motor (not shown) may be operated at a target rotational speed under the control of the main controller 310.

Meanwhile, the machine room fan driver 117 includes a machine room fan motor (not shown), and the machine room fan motor (not shown) may be operated at a target rotational speed under the control of the main controller 310.

When such a motor is a three-phase motor, it may be controlled by a switching operation in an inverter (not shown) or may be controlled at a constant speed by using an AC power source intactly. Here, each motor (not shown) may be any one of an induction motor, a Blush less DC (BLDC) motor, a synchronous reluctance motor (synRM) motor, and the like.

Meanwhile, as described above, the main controller 310 may control the overall operation of the refrigerator 100, in addition to the operation control of the compressor 112 and the fan 115 or 144.

For example, as described above, the main controller 310 may control the overall operation of the refrigerant cycle based on the set temperature from the input device 220. For example, the main controller 310 may further control a three-way valve (not shown), a refrigerating compartment expansion valve (not shown), and a freezer compartment expansion valve 132, in addition to the compressor driver 113, the refrigerating compartment fan driver 143, and the freezer compartment fan driver 145. In addition, the operation of the condenser 116 may also be controlled. In addition, the main controller 310 may control the operation of the display device 230.

Meanwhile, the heater 330 may be a freezer compartment defrost heater. For removing frost attached to the freezer compartment evaporator 122, the freezer compartment defrost heater 330 may operate. To this end, the heater driver 332 may control the operation of the heater 330. Meanwhile, the main controller 310 may control the heater driver 332.

Meanwhile, the main controller 310 may output a driving signal to the RF driver 195 so as to control the RF output device 190.

Figure 5A:
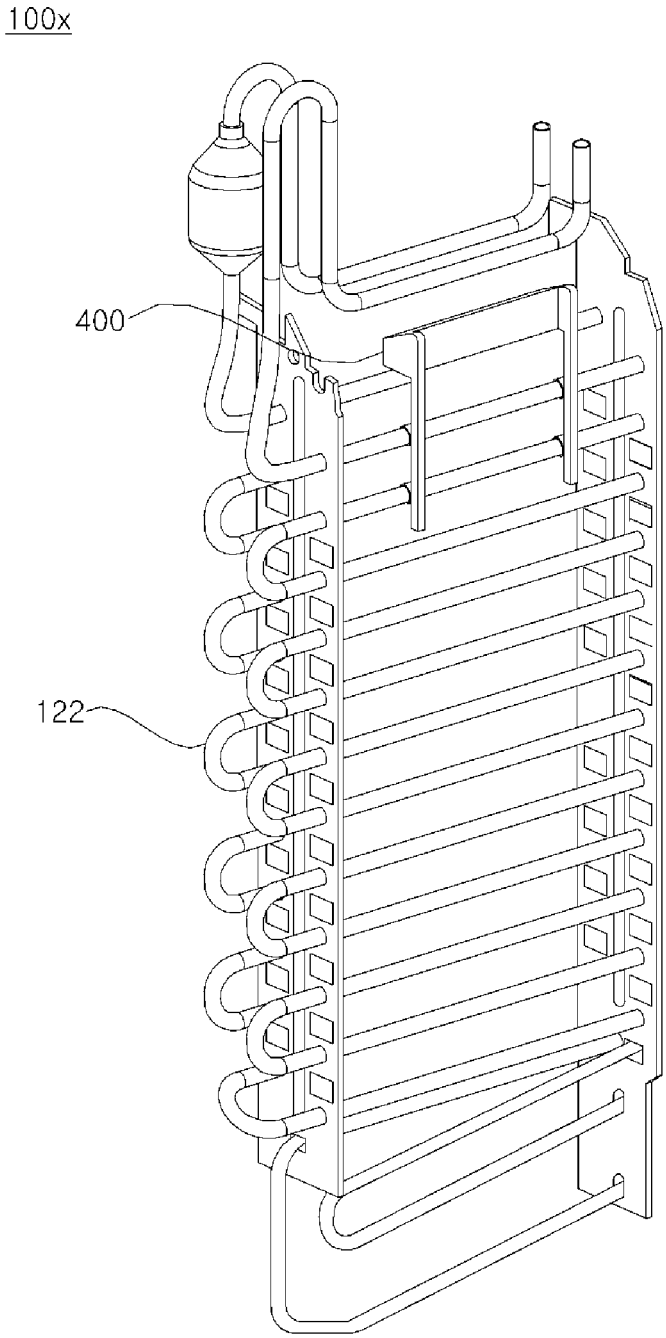
FIG. 5A is a perspective view illustrating an example of an evaporator associated with the present disclosure.
Figure 5B:
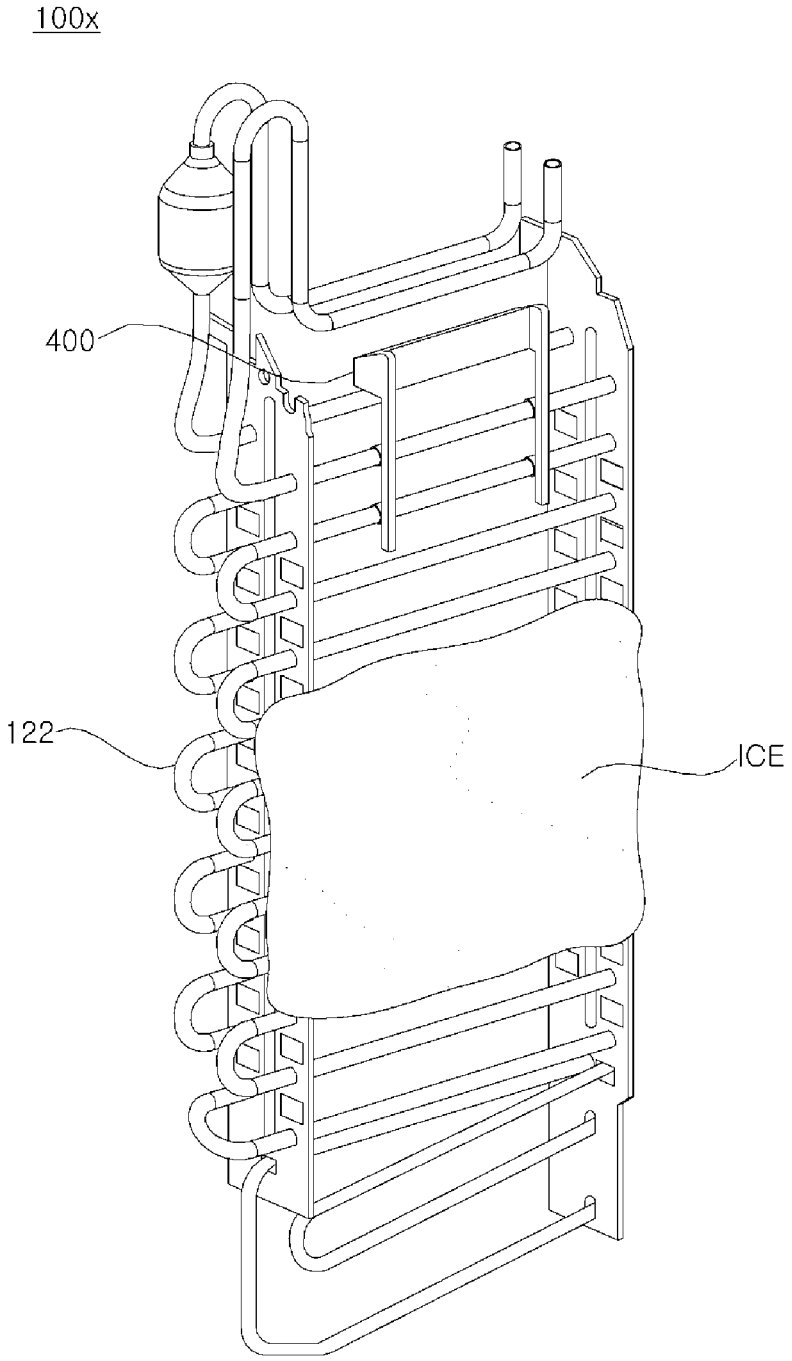
FIG. 5B is a diagram referred to in the description of FIG. 5A.

FIG. 5A is a perspective view illustrating an example of an evaporator associated with the present disclosure, and FIG. 5B is a diagram referred to in the description of FIG. 5A.

First, referring to FIG. 5A, the evaporator 122 in a refrigerator 100*x* may be a freezer compartment evaporator, as illustrated in FIG. 2. A sensor mounter 400 may be attached to the evaporator 122.

Meanwhile, FIG. 5B illustrates an example in which frost ICE is formed on the evaporator 122.

In the drawing, the frost ICE is formed on a center portion of the evaporator 122, but the frost is not limited thereto and may be formed from a lower region of the evaporator 122 and grows upward.

Figure 6:
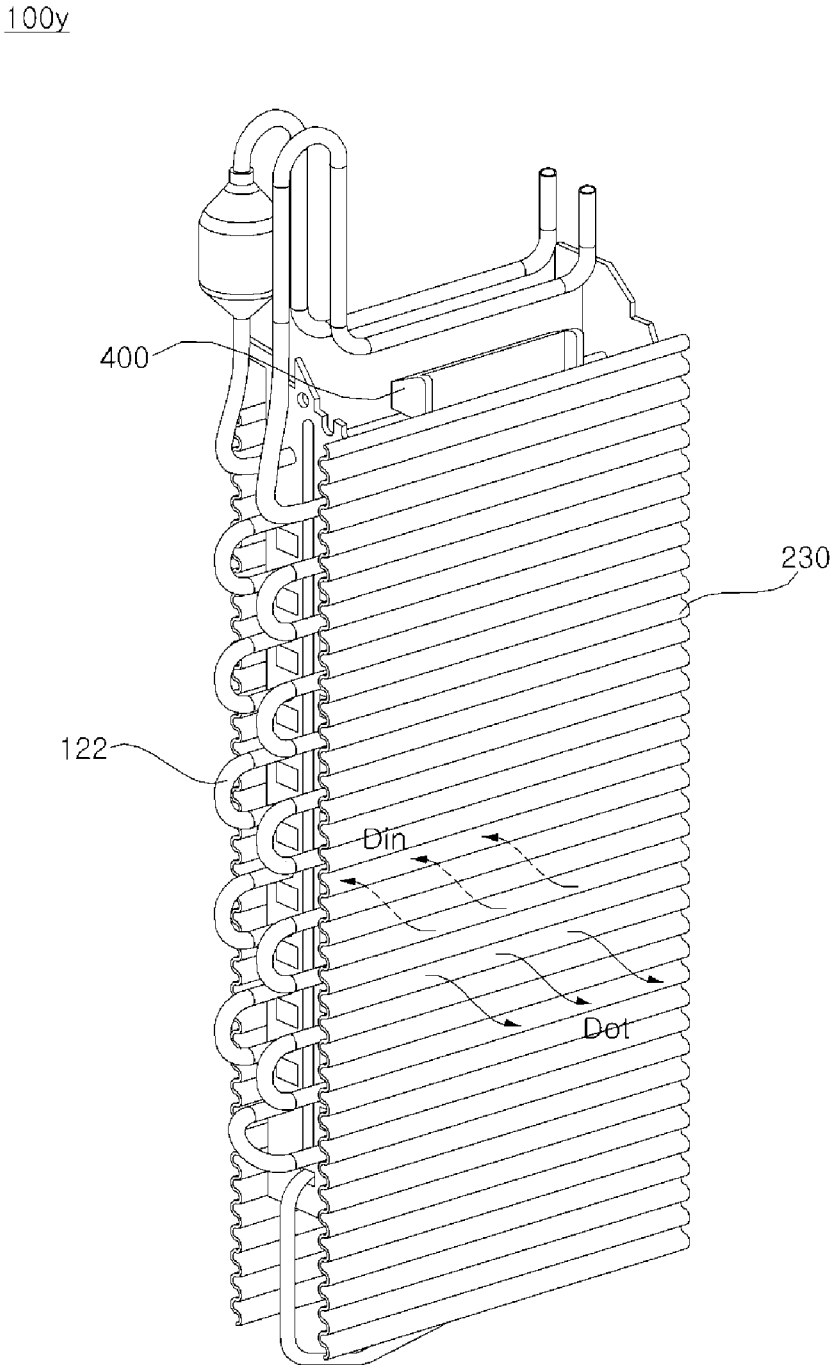
FIG. 6 is a perspective view illustrating another example of an evaporator associated with the present disclosure.

FIG. 6 is a perspective view illustrating another example of an evaporator associated with the present disclosure.

Referring to the drawing, in a refrigerator 100*y*, a heater wire 230 coated on an insulation film may be attached to the evaporator 122 to remove the frost ICE illustrated in FIG. 5B.

In this case, the operation of the defrost heater wire leads to a rise in temperature of the defrost heater wire to approximately 100° C. or higher.

Meanwhile, in the drawing, it is illustrated that heat from the heater wire 230 is transferred leftward to the evaporator 122 in a direction Din, as well as transferred rightward in an opposite direction Dot to the evaporator 122.

The heat transferred in the opposite direction Dot to the evaporator 122 causes a problem in that hot air is introduced into the refrigerating chamber or the freezer chamber, such that temperature inside the refrigerating chamber or the freezer chamber may rather increase.

Accordingly, the present disclosure provides a method of performing a defrosting operation by using an RF signal while reducing heat generation, which will be describe below with reference to FIG. 7A and the following figures.

Figure 7A:
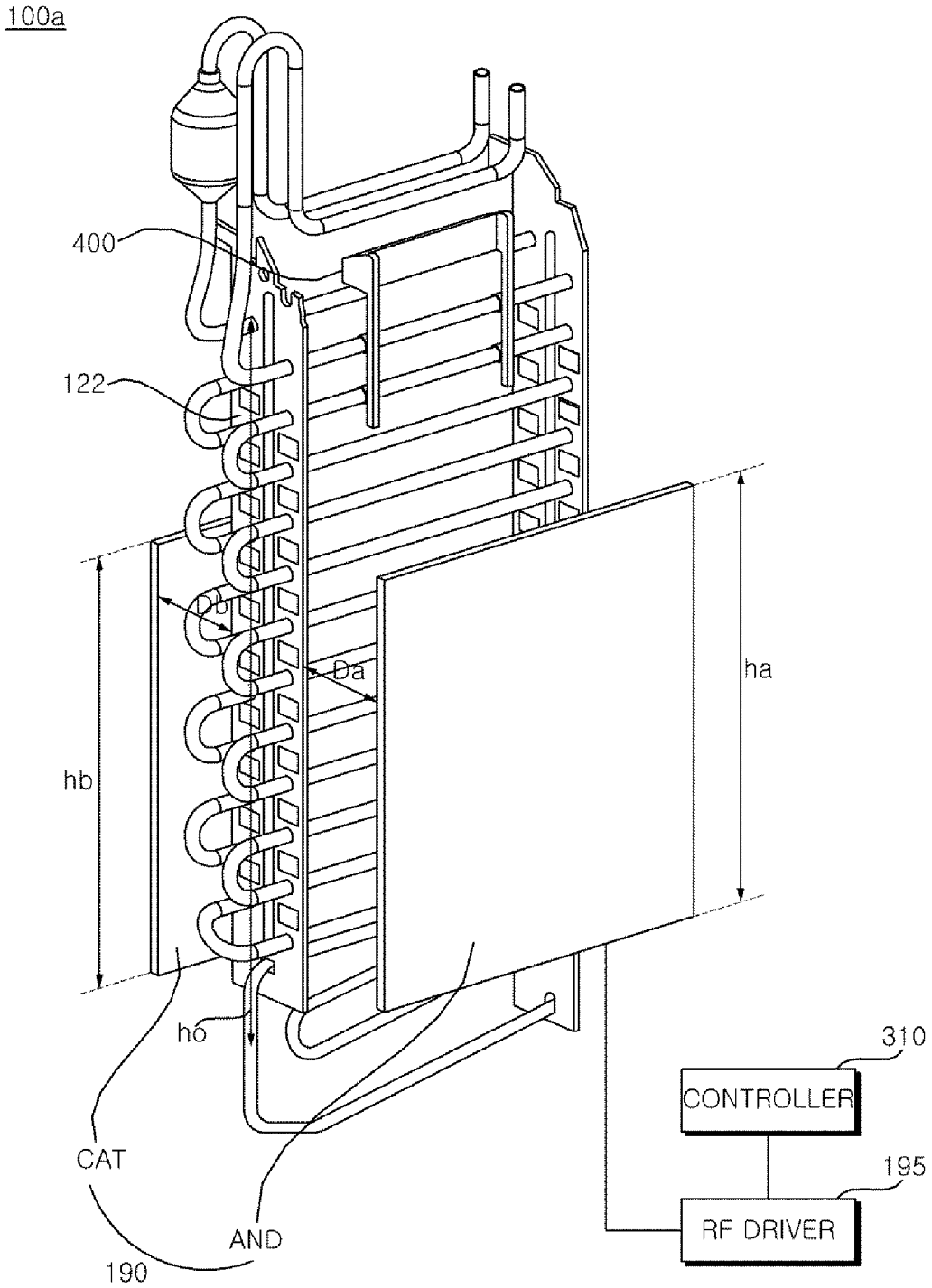
FIG. 7A is a diagram illustrating an RF output device and an evaporator according to an embodiment of the present disclosure.

FIG. 7A is a diagram illustrating an RF output device and an evaporator according to an embodiment of the present disclosure.

Referring to the drawing, a refrigerator 100*a* according to an embodiment of the present disclosure includes an evaporator 122 configured to perform heat exchange by using a refrigerant compressed by a compressor 112; an RF output device 190 configured to output an RF signal to the evaporator 122 for removing frost formed on the evaporator 122; and a main controller 310 configured to control the RF output device 190.

Meanwhile, the evaporator 122 may be a freezer compartment evaporator, as illustrated in FIG. 2.

Meanwhile, the sensor mounter 400 may be attached to the evaporator 122.

To this end, the sensor mounter 400 may have a frame portion, and leg portions attached to the frame portion and extending in a vertical direction. Further, a pipe connector, which may be connected to a pipe of the evaporator 122, may be disposed at the respective leg portions.

Meanwhile, the frame portion may have an insertion space, into which a circuit board (not shown) having a frost sensor (not shown) for detecting the presence of frost may be inserted. The circuit board 450 illustrated in the drawing may be slidably inserted into the insertion space in the frame portion and may be fixed thereto.

Meanwhile, the RF output device 190 according to an embodiment of the present disclosure may include a first plate AND and a second plate CAT which are spaced apart from each other on the evaporator 122.

Meanwhile, at least one of the first plate AND and the second plate CAP is preferably disposed facing at least a lower portion of the evaporator 122. This is because, as illustrated in FIG. 5B, a position where frost is first formed on the evaporator 120 is the lower portion, and the frost grows upward from the lower portion.

In the drawing, the evaporator 122 has a height of ho, and the first plate AND and the second plate CAP have a height of hb, which is lower than ho.

Meanwhile, at least one of the first plate AND and the second plate CAP may be electrically connected to an RF signal transmitter 312.

Meanwhile, when an electrical signal is applied to at least one of the first plate AND and the second plate CAT, the RF signal may be output to the frost ICE on the evaporator 122.

Accordingly, the frost ICE on the evaporator 122 may be removed using the RF signal, without using a separate defrost heater.

Meanwhile, based on the RF signal, the main controller 310 controls the frost ICE to phase change into a liquid by heat radiated from a plurality of metal fins of the evaporator 122; and after the phase change, the main controller 310 may control temperature of the phase changed liquid to increase by the water molecule movement based on the RF signal. Accordingly, defrosting may be performed using the RF signal. Particularly, defrosting may be performed while reducing heat generation.

Meanwhile, in the refrigerator 100 according to an embodiment of the present disclosure, temperature of the plurality of metal fins of the evaporator 122 is preferably higher than temperature of the phase changed liquid near the metal fins. Accordingly, defrosting may be performed while reducing heat generation.

Meanwhile, in the refrigerator 100 according to an embodiment of the present disclosure, as a frequency of the RF signal increases, temperature of heat radiated from the plurality of metal fins may increase. Accordingly, defrosting may be performed while reducing heat generation.

Meanwhile, in the refrigerator 100 according to an embodiment of the present disclosure, as the number of the metal fins of the evaporator 122 increases, or as a distance between the metals fins of the evaporator 122 decreases, heat radiated from the metal fins may increase. Accordingly, defrosting may be performed efficiently using the RF signal.

Meanwhile, the refrigerator 100 according to an embodiment of the present disclosure may further include a defrost heater for removing frost on the evaporator 122, and the main controller 310 may control the defrost heater to operate following the operation of the RF output device 190. Accordingly, defrosting may be performed efficiently using the RF signal.

Meanwhile, the refrigerator 100 according to an embodiment of the present disclosure may further include a defrost sensor for sensing the amount of frost on the evaporator 122, and the main controller 310 may change at least one of an output period and output power of the RF signal based on the amount of frost during the operation of the RF output device 190. Accordingly, defrosting may be performed efficiently using the RF signal.

Meanwhile, a frequency of the RF signal according to an embodiment of the present disclosure is preferably between 13.56 MHz and 433 MHz. Accordingly, defrosting may be performed efficiently using the RF signal.

Figure 7B:
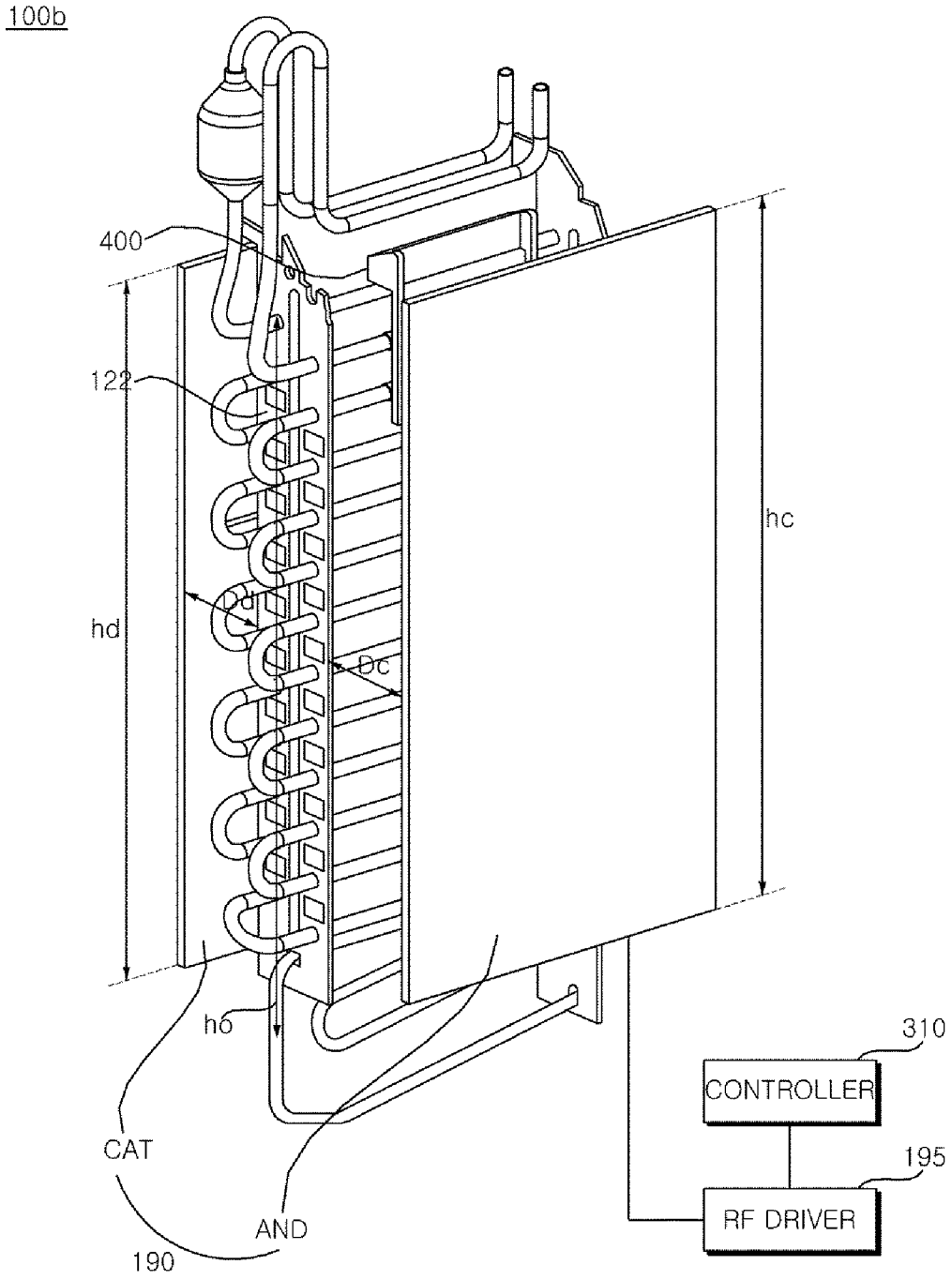
FIG. 7B is a diagram illustrating an RF output device and an evaporator according to another embodiment of the present disclosure.

FIG. 7B is a diagram illustrating an RF output device and an evaporator according to another embodiment of the present disclosure.

Referring to the drawing, a refrigerator 100*b* according to another embodiment of the present disclosure may include an evaporator 122 configured to perform heat exchange by using a refrigerant compressed by a compressor 112; an RF output device 190 configured to output an RF signal to the evaporator 122 for removing frost on the evaporator 122; and a main controller 310 configured to control the RF output device 190.

In this case, in the RF output device 190 according to another embodiment of the present disclosure, the evaporator 122 has a height of ho, and the first plate AND and the second plate CAP have heights of hc and hd, respectively, which are almost the same as the height of the evaporator 122.

Accordingly, the RF signal may be output over the whole area of the evaporator 122, such that frost may be removed from the entire area of the evaporator 122.

Figure 7C:
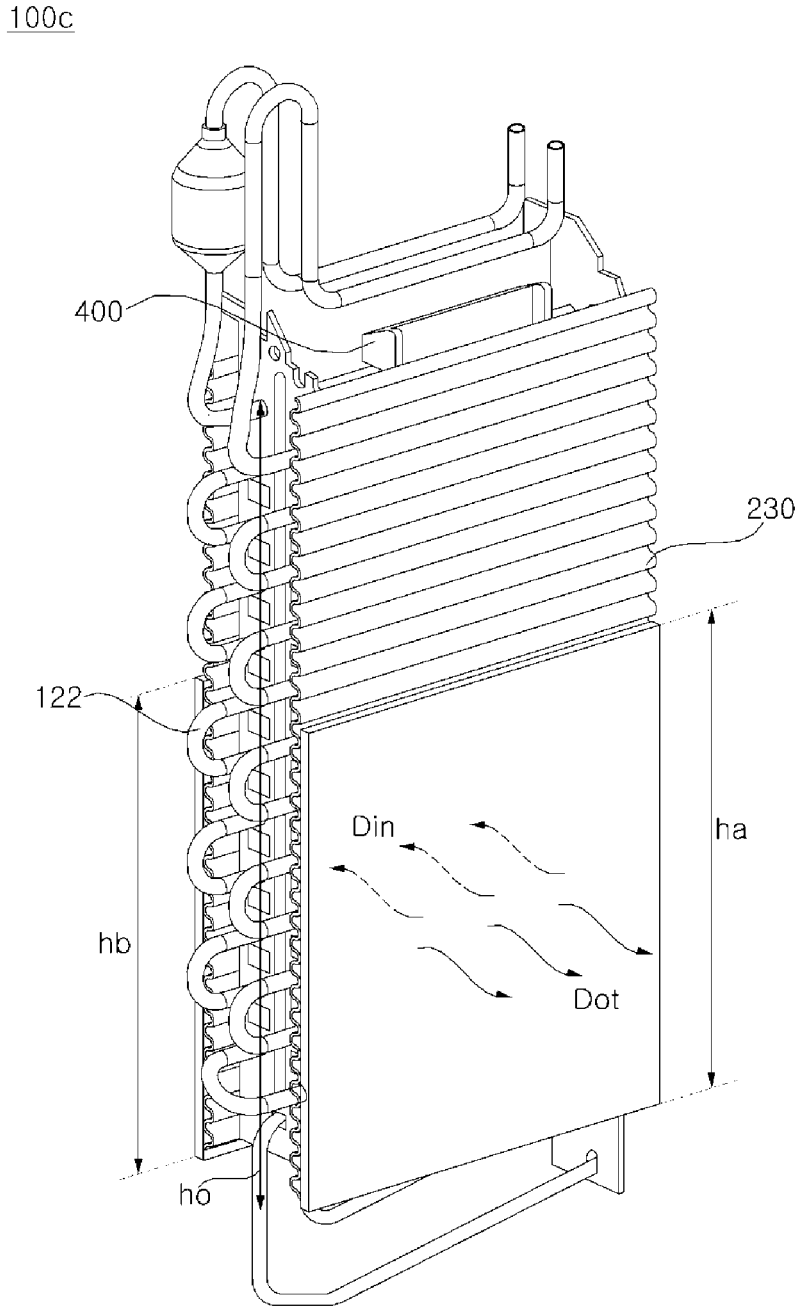
FIG. 7C is a diagram illustrating an RF output device and an evaporator according to yet another embodiment of the present disclosure.

FIG. 7C is a diagram illustrating an RF output device and an evaporator according to yet another embodiment of the present disclosure.

Referring to the drawing, a refrigerator 100*c* according to yet another embodiment of the present disclosure may include an evaporator 122 configured to perform heat exchange by using a refrigerant compressed by a compressor 112; an RF output device 190 configured to output an RF signal to the evaporator 122 for removing frost on the evaporator 122; and a main controller 310 configured to control the RF output device 190.

In this case, the RF output device 190 according to yet another embodiment of the present disclosure may include a first plate AND and a second plate CAP which are spaced apart from each other on the evaporator 122.

In addition, the RF output device 190 according to yet another embodiment of the present disclosure may further include a heat insulating material 230 disposed on a surface opposite to at least one evaporator 122 of the first plate AND and the second plate CAP.

By using the heat insulating material, frost formed on the evaporator 122 may be removed more efficiently.

Meanwhile, in the drawing, it is illustrated that the heat insulating material has a height which is almost the same as the height ho of the evaporator 122, and is greater than the height ha of the first plate AND and the second plate CAP.

Meanwhile, unlike the drawing, the height of the heat insulating material may also be equal to the height of the first plate AND and the second plate CAT.

Figure 8:
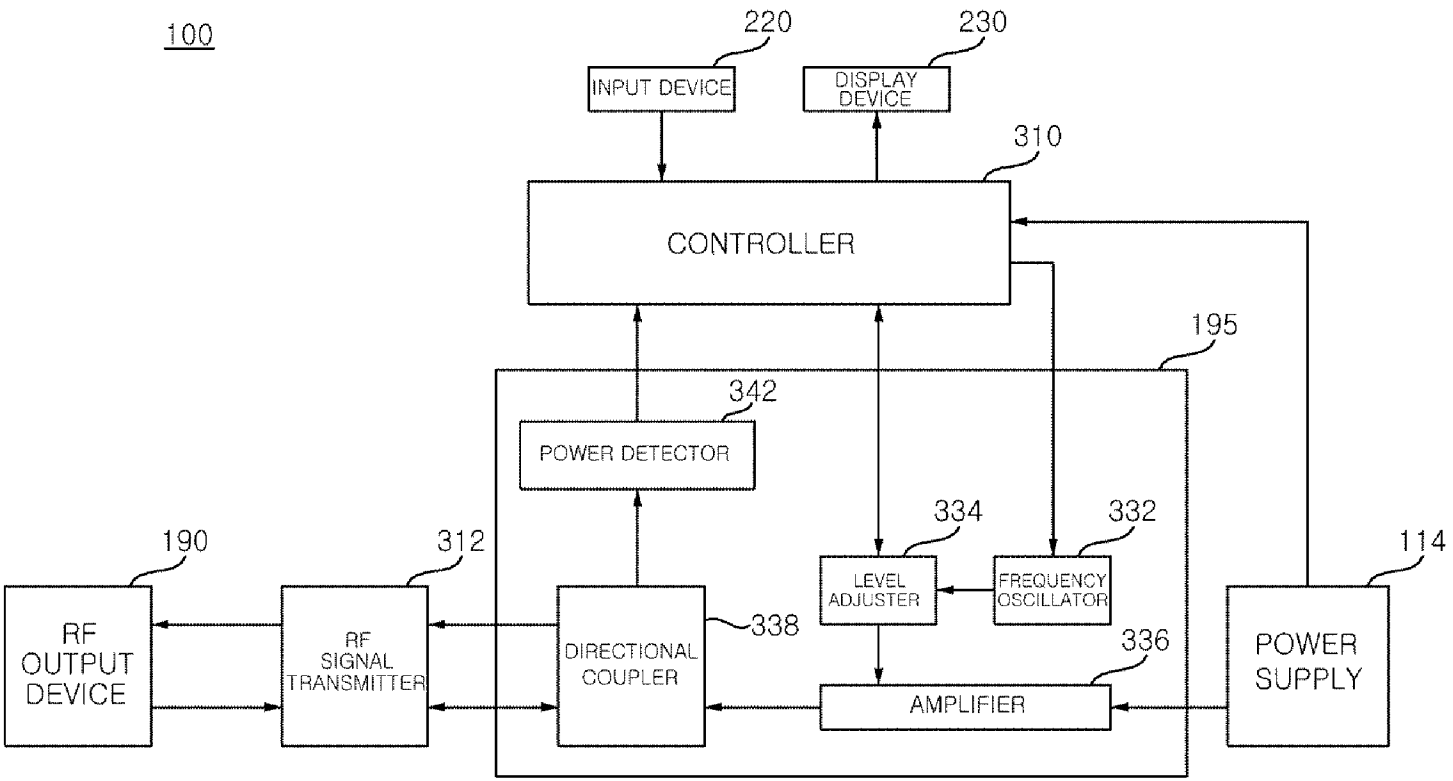
FIG. 8 is a block diagram illustrating the interior of an RF output device according to an embodiment of the present disclosure.

FIG. 8 is a block diagram illustrating the interior of an RF output device according to an embodiment of the present disclosure.

Referring to the drawing, the RF output device 190 may be connected to the RF signal transmitter 312, and the RF signal transmitter 312 may be connected to the RF driver 195.

The input device 220 may include a separate button for operating on or off the RF output device 190.

The display device 230 may display information related to the operating on or off of the RF output device 190.

The main controller 310 may control the RF output device 190 by using the RF driver 195.

The RF driver 195 may include a frequency oscillator 332, a level adjuster 334, an amplifier 336, a directional coupler 338, and a power detector 342.

The frequency oscillating device 332 oscillates to output an RF signal of a corresponding frequency, by a frequency control signal from the main controller 310.

The frequency oscillator 322 may include a voltage controlled oscillator VCO. Based on the voltage level of the frequency control signal, the voltage controlled oscillator VCO oscillates a corresponding frequency. For example, as the voltage level of the frequency control signal becomes higher, the frequency oscillated and generated by the voltage controlled oscillator VCO becomes higher.

The level adjuster 334 may oscillate the frequency signal oscillated by the frequency oscillator 332 to output an RF signal with a corresponding power based on the power control signal. The level adjuster 334 may include a voltage controlled attenuator VCA.

Based on the voltage level of the power control signal, the voltage controlled attenuator VCA performs a correction operation so that an RF signal is output with a corresponding power. For example, as the voltage level of the power control signal becomes higher, the power level of the signal output from the voltage controlled attenuator VCA becomes higher.

The amplifier 336 may output a RF signal by amplifying the oscillated frequency signal, based on the frequency signal oscillated by the frequency oscillator 332 and the power control signal by the level adjuster 334.

As described above, the amplifier 336 may include a solid state power amplifier SSPA using a semiconductor device, and in particular, may include a Monolithic Microwave Integrated Circuits MMIC using a single substrate. Thus, the size thereof is reduced, and the integration of device can be achieved.

Meanwhile, the frequency oscillator 332, the level adjuster 334, and the amplifier 336, described above, may be implemented as a single device, which may be referred to as a solid state power oscillator SSPO.

The directional coupler DC 338 transmits the RF signal amplified and output by the amplifier 336 to the RF signal transmitter 312. The RF signal output from the RF signal transmitter 312 is output to the goods in the RF output device 190.

Meanwhile, the RF signal that is not absorbed and reflected by the goods in the RF output device 190 may be input to the directional coupler 338 through the RF signal transmitter 312. The directional coupler 338 transfers the reflected RF signal to the main controller 310.

Meanwhile, the power detector 342 is disposed between the directional coupler 338 and the main controller 310, and detects the output power of the RF signal which is amplified and output by the amplifier 336 and transferred to the RF signal transmitter 312 via the directional coupler 338. The detected power signal is input to the main controller 310, and is used for a signal output efficiency calculation. Meanwhile, the power detector 342 may be implemented of a diode device, or the like to detect a power.

Meanwhile, the power detector 342 is disposed between the directional coupler 338 and the main controller 310, and detects the power of the reflected RF signal reflected by the RF output device 190 and received by the directional coupler 338. The detected power signal is input to the main controller 310, and is used for signal output efficiency calculation. Meanwhile, the power detector 342 may be implemented of a diode device, or the like to detect a power.

Meanwhile, the RF driver 195 is disposed between the amplifier 336 and the directional coupler 338, and may further include an isolation device (not shown) for passing through the RF signal in the case of transferring the RF signal amplified by the amplifier 336 to the RF output device 190, and blocking the RF signal reflected from the RF output device 190. Here, the isolation device (not shown) may be implemented of an isolator.

The main controller 310 may calculate signal output efficiency, based on the RF signal which is not absorbed and reflected by the goods among the RF signals emitted into the RF output device 190.

Meanwhile, when the plurality of RF signals are sequentially emitted into the RF output device 190, the main controller 310 calculates signal output efficiency for each frequency of the plurality of RF signals.

Meanwhile, the main controller 310 may control a RF signal output section to be divided into a scan section and a main operation section so as to output signal efficiently.

The main controller 310 may sequentially output a plurality of RF signals into the RF output device 190 during the scan section, and calculate signal output efficiency based on the reflected RF signal.

In addition, the main controller 310 may output RF signals having different output periods respectively or output only the RF signal having a certain frequency, in the main operation section, based on the signal output efficiency calculated in the scan section. Meanwhile, it is preferable that the power of the RF signal in the main operation section is significantly higher than the power of the RF signal in the scan section. Thus, power consumption can be reduced.

The main controller 310 may generate and output a frequency control signal to vary the output period of the RF signal based on the calculated signal output efficiency.

Meanwhile, the main controller 310 may control to output the RF signal of corresponding frequency, only when the signal output efficiency calculated for each frequency is equal to or greater than a set value.

The power supply 114 may boost the power input to the refrigerator 100 to a high voltage and output to the RF driver 195. The power supply 114 may be implemented of a high voltage transformer or an inverter.

Figure 9:
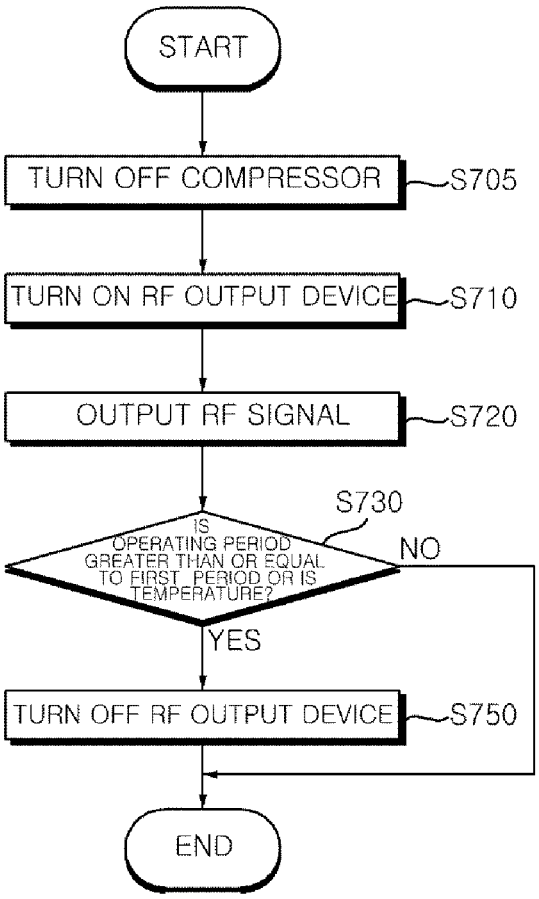
FIG. 9 is a flowchart illustrating an operating method of a refrigerator according to an embodiment of the present disclosure.
Figure 10A:
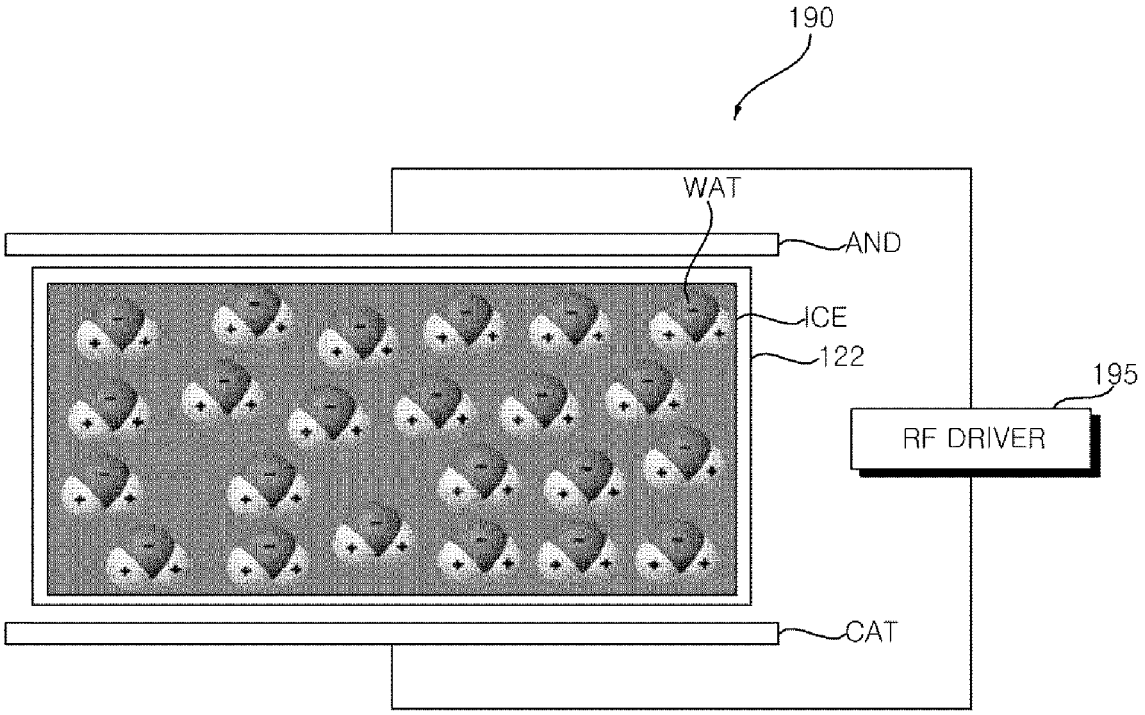
FIGS. 10A to 14 are diagrams referred to in the description of FIG. 10.

FIG. 9 is a flowchart illustrating an operating method of a refrigerator according to an embodiment of the present disclosure, and FIGS. 10A to 14 are diagrams referred to in the description of FIG. 10.

First, referring to FIG. 9, the main controller 310 turns off the compressor 1120 (S705).

Then, the main controller 310 turns on the RF output device 190 (S710) for defrosting, such that the RF signal is output to the evaporator 122 (S720).

Meanwhile, in the present disclosure, the RF signal that causes the movement of water molecules in the goods is output to remove frost formed on the evaporator 122.

Particularly, a frequency of the RF signal is preferably between 13.56 MHz and 433 MHz.

When the frequency of the RF signal is between 13.56 MHz and 433 MHz, as it is not 2.4 GHz for high-speed vibration of water molecules, the water molecule motion is performed in a range where an object is not heated. Thus, frost may be removed efficiently while reducing the rise in ambient temperature.

Meanwhile, the main controller 310 determines whether an operating period is greater than or equal to a first period, or ambient temperature around the evaporator is greater than or equal to a first temperature (S730), and if so, the main controller 310 may turn off the RF output device 190 (S750).

FIG. 10A illustrates an example in which the evaporator 122 is disposed between the first plate AND and the second plate CAP, and frost ICE is formed on the evaporator 122.

Particularly, in the drawing, it is illustrated that water molecules are in a frozen state.

In this embodiment of the present disclosure, the main controller 310 controls the frost to phase change into a liquid by heat radiated from the plurality of metal fins of the evaporator 122, and after the phase change, the main controller 310 controls temperature of the phase changed liquid to increase by the water molecule movement based on the RF signal. Accordingly, defrosting may be performed using the RF signal. Particularly, defrosting may be performed while reducing heat generation.

When the plurality of metal fins of the evaporator 122 react to the RF signal, ice around the plurality of metal fins is melted.

Figure 10B:
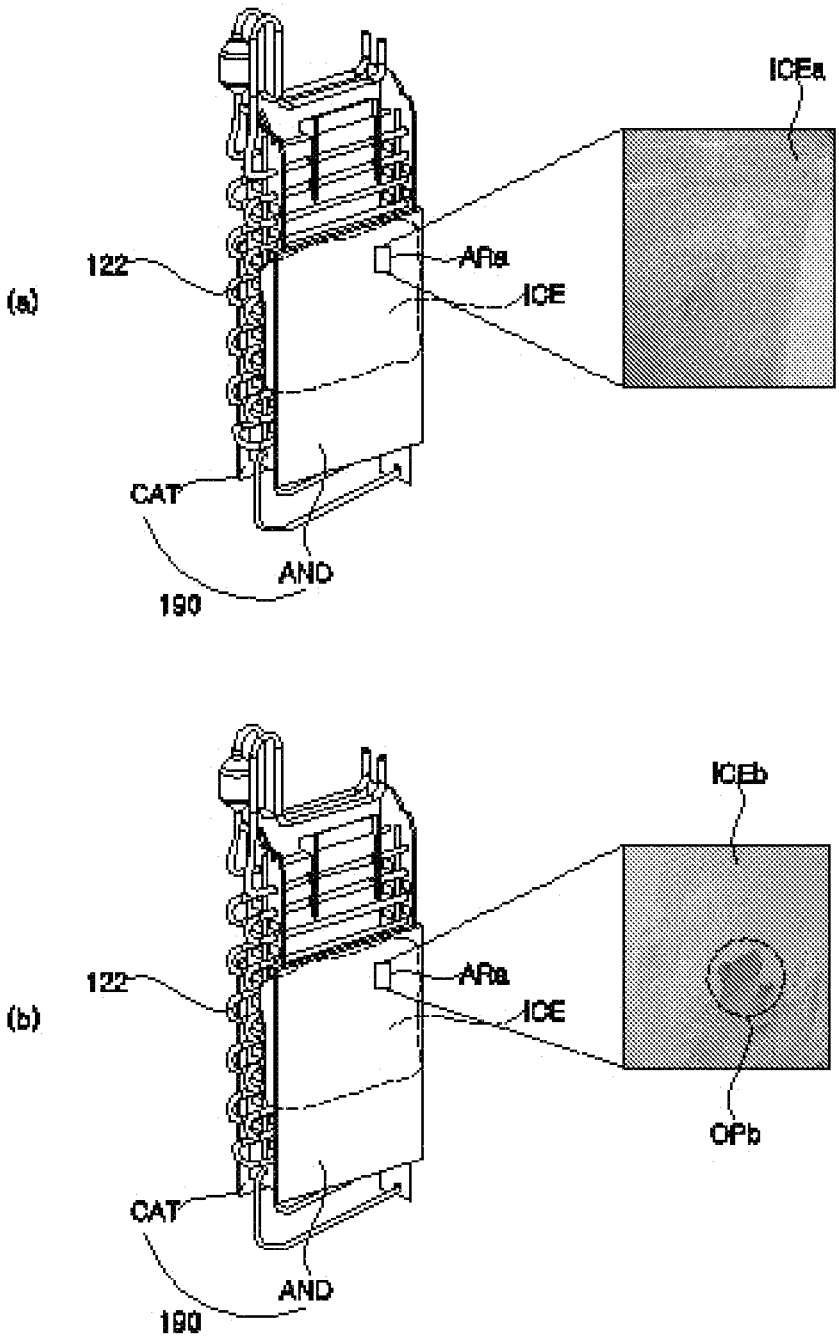

In FIG. 10B, (a) illustrates an example in which the RF signal is output at a first time point to the frost ICE formed on the evaporator 122 within the first plate AND, in which as it is still at the initial stage, almost no frost ICE is melted.

In FIG. 10B, (b) illustrates an example in which the RF signal is output at a second time point, after the first time point, to frost ICE formed on the evaporator 122 within the first plate AND.

Referring to the drawings, when time elapses after the first time point, the plurality of metal fins react to the RF signal, such that a surrounding region OPb around the plurality of metal fins of the evaporator 122 is melted first.

Meanwhile, a defrosting method of a defrost heater is a method of removing frost using a defrost heater, in which a surrounding region around the heater is melted first, and a surrounding region around the plurality of metal fins of the evaporator 122 is melted last.

Meanwhile, as a defrost period is limited, the defrost heater method has a problem in that it is difficult to continuously remove frost formed in the surrounding region around the plurality of metal fins of the evaporator 122.

However, in the defrosting method using the RF signal according to the present disclosure, unlike the defrosting method of a defrost heater, the surrounding area OPb around the plurality of metal fins is melted first, and then other surrounding regions are sequentially melted, such that defrosting may be performed efficiently in a short time.

Figure 10C:
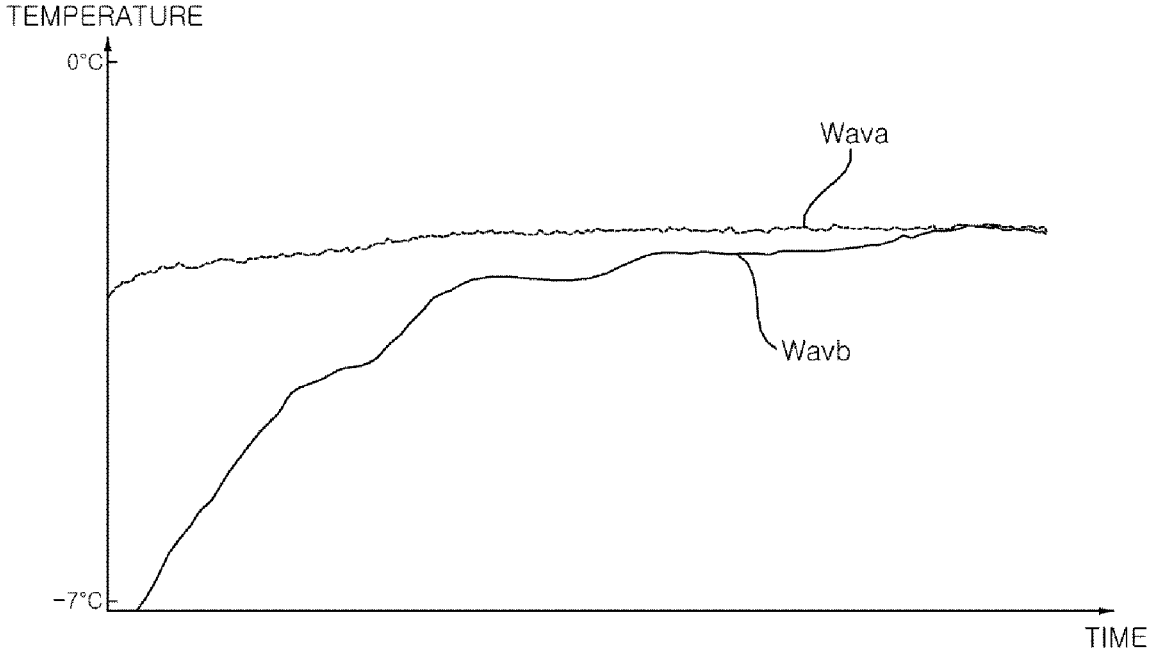

FIG. 10C illustrates an ambient temperature curve Wava around the RF output device 190, and a temperature curve Wavb of frost on the evaporator 122.

It can be seen from the drawing that in the initial stage of operation of the RF output device 190, a temperature difference between the RF output device 190 and the frost on the evaporator 122 is large, but as the RF signal is output continuously, the temperature of the frost on the evaporator 122 increases to approach the ambient temperature around the RF output device 190. Accordingly, the frost on the evaporator 122 may be removed stably.

Meanwhile, regarding FIG. 10C, the main controller 310 according to an embodiment of the present disclosure may control the evaporator 122 to operate during periods, which are divided into a first period in which the RF signal is output such that temperature of a liquid around the evaporator 122 decreases, and a second period in which the liquid temperature increases after the first period, and then is maintained within a predetermined range.

Here, although not illustrated herein, the first period corresponds to a predetermined period after the RF signal is output, and despite the output of the RF signal, the temperature of the liquid around the evaporator 122 may decrease due to the heat exchange in the evaporator 122.

Meanwhile, the second period may correspond to the entire section of the temperature curve Wavb of the frost illustrated in FIG. 10C.

As described above, by the RF signal output during the second period, the liquid temperature may increase, and then may be maintained within a predetermined range. Accordingly, defrosting may be performed using the RF signal. Particularly, defrosting may be performed while reducing heat generation.

Figure 11:
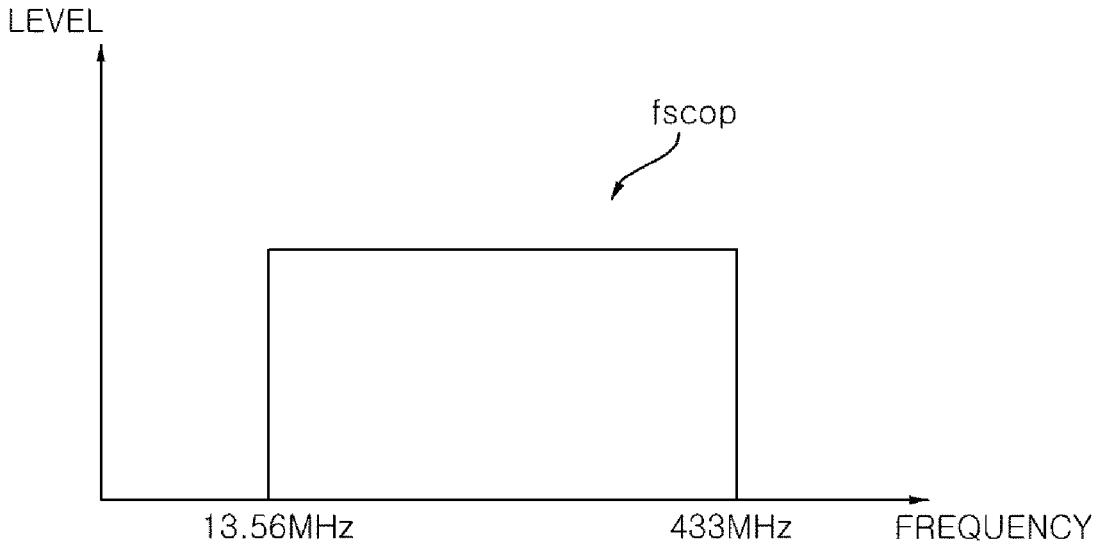

FIG. 11 illustrates a range of frequencies output by the RF output device 190.

Referring to the drawing, a frequency range fscop of the RF signal is preferably between 13.56 MHz and 433 MHz.

For example, if the frequency of the RF signal is lower than 13.56 MHz, movement of water molecules in the goods may not be active; and if the frequency of the RF signal is higher than 433 MHz, movement of water molecules in the goods may be too active, causing a temperature rise of the goods.

Accordingly, in the present disclosure, the frequency range fscop of the RF signal used in the RF output device 190 is between 13.56 MHz and 433 MHz.

Meanwhile, depending on the amount of frost, the frequency of the RF signal may vary between 13.56 MHz and 433 MHz.

For example, the amount of frost increases, the frequency of the RF signal may increase.

Meanwhile, power consumption may increase during the operation of the RF output device 190, rather than before the operation of the RF output device 190, which will be described below with reference to FIG. 12.

Figure 12:
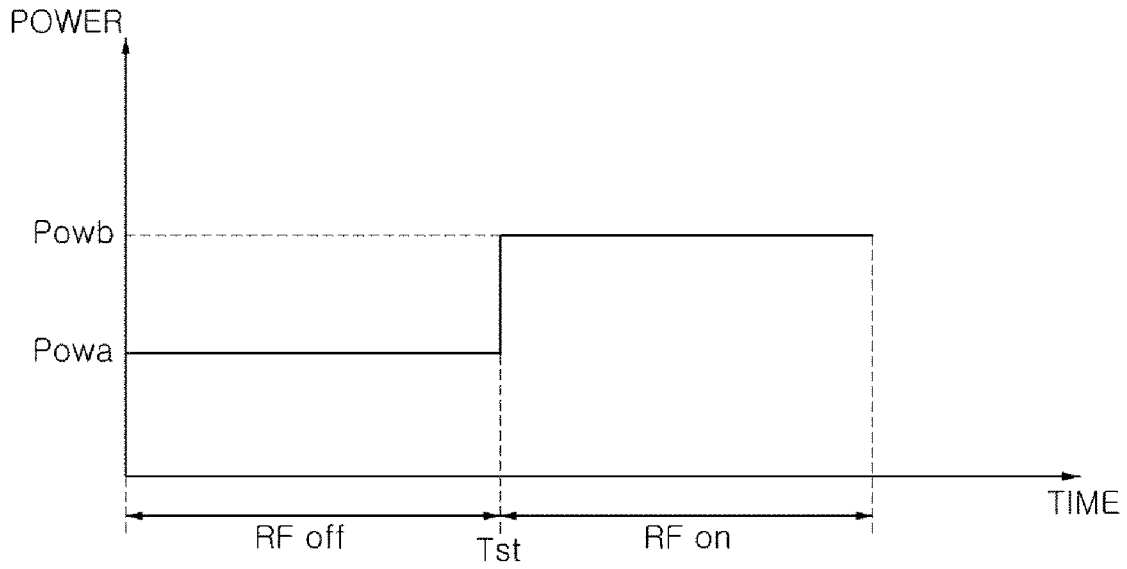

FIG. 12 illustrates an example in which power consumed by the compressor 112 before the operation of the RF output device 190 is Powa, and power consumed by the compressor 112 during the operation of the RF output device 190 is Powb which is greater than Powa.

When the RF output device 190 is disposed near the evaporator 112 for a defrosting operation, power consumed by the compressor 112 may increase more during the operation of the RF output device 190, in order to maintain a setting temperature of the freezer compartment at −18° C.

Meanwhile, it is preferable that the RF output device 190 mainly operates in a defrost interval, which will be described below with reference to FIGS. 13A and 13B.

Figure 13A:
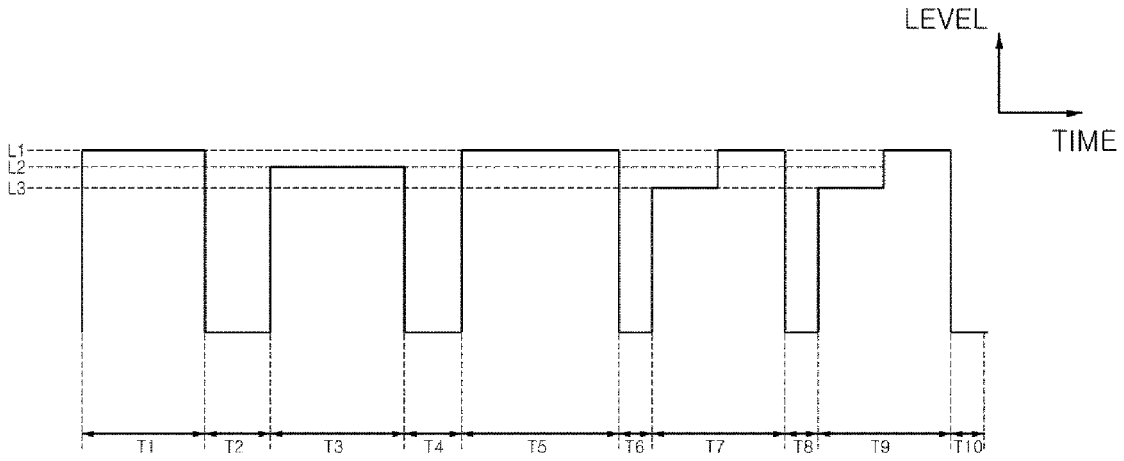

First, FIG. 13A illustrates an example of a defrosting operation.

Referring to the drawing, FIG. 13A is a timing diagram illustrating an operating period of a refrigerator and power consumption during the operating period of the refrigerator.

First, a first section t1 is a cooling section, in which the compressor 112 is turned on to operate and a fan 144 is also turned on to operate. During the cooling section t1, first power L1 is consumed to perform the compressor 112.

Meanwhile, the first section t1 may be referred to as a deep cooling section or a cooling section before defrosting starts.

Then, a second section t2 is an idle section, in which the compressor 112 is turned off, and the fan 144 is also turned off. Meanwhile, the second section t2 may be referred to as an idle section before defrosting starts.

Meanwhile, the refrigerant in the evaporator 122 may be removed during the second section t2 before defrosting starts. Such operation may be referred to as pump down.

Subsequently, a third section t3 is a defrost section, in which the RF output device 190 operates. Accordingly, frost near the evaporator 122 may be removed efficiently and stably.

Meanwhile, second power L2, which is lower than the power consumed in the cooling section t1, may be consumed during the defrost section t3.

Next, a fourth section t4 is an idle section after defrost. Accordingly, the compressor 112 may be turned off.

Then, a fifth section t5 is a cooling section after defrost, in which the compressor 112 is turned on to operate, and the fan 144 is also turned on to operate. In the cooling section after defrost t5, the first power L1 is consumed to operate the compressor 112.

Subsequently, a sixth section t6 is a second idle section after defrost, in which the compressor 112 may be turned off.

Next, a seventh section t7 is a second cooling section after defrost, in which the compressor 112 is turned on to operate, and the fan 144 is also turned on to operate.

At an initial stage of the second cooling section after defrost t7, third power L3, which is lower than the first power L1 and the second power L2, is consumed, and then the first power L1 is consumed again.

Then, an eighth section t8 is a third idle section after defrost, in which the compressor 112 may be turned off.

Subsequently, a ninth section t9 is a third cooling section after defrost, in which the compressor 112 is turned on to operate, and the fan 144 is also turned on to operate.

At an initial stage of the third cooling section after defrost t9, the third power L3, which is lower than the first power L1 and the second power L2, is consumed, and then the first power L1 is consumed again.

Next, a tenth section t10 is a fourth idle section after defrost, in which the compressor 112 may be turned off.

Meanwhile, as the defrost section t3 decreases, or as the amount of frost on the evaporator 122 increases, or as a period of the defrost section t3 increases, the main controller 310 according to an embodiment of the present disclosure may increase the frequency of the RF signal. Accordingly, defrosting may be performed efficiently by using the RF signal.

Meanwhile, the main controller 310 according to an embodiment of the present disclosure may control the RF signal to be output to the evaporator 122 during at least the defrost section t3. Accordingly, defrosting may be performed efficiently by using the RF signal.

Meanwhile, during a portion of the cooling section t1 before defrosting, the idle section t2 following the cooling section t1 before defrosting, the defrost section t3, the idle section after defrost t4, and a portion of the cooling section after defrost t5, the main controller 310 may control the RF signal to be output to the evaporator 122. Accordingly, defrosting may be performed stably by using the RF signal.

Meanwhile, the main controller 310 according to an embodiment of the present disclosure may control the compressor 112 to be turned off during the operation of the RF output device 190. Accordingly, power consumption may be reduced while performing defrosting using the RF signal.

Meanwhile, once the cooling section for operation of the refrigerating compartment 157 or the freezer compartment 155 starts after the operation of the RF output device 190, the main controller 310 according to an embodiment of the present disclosure may control the RF output device 190 to stop outputting the RF signal. Accordingly, a cooling operation may be performed smoothly during the cooling section, and power consumption of the refrigerator 100 may be reduced.

Meanwhile, the main controller 310 according to an embodiment of the present disclosure may control the RF output device 190 to operate in the idle section t2 and the defrost section t3 following the idle section t2. Accordingly, defrosting may be performed efficiently using the RF signal.

Meanwhile, the main controller 310 according to an embodiment of the present disclosure may control the RF output device 190 to be further operated during a portion of the cooling section before defrost t1 before the idle section t2. Accordingly, defrosting may be performed stably using the RF signal.

Meanwhile, the main controller 310 according to an embodiment of the present disclosure may control the RF output device 190 to be further operated during at least a portion of the idle section after defrost t4 following the idle section t2, and the cooling section after defrost t5 following the idle section after defrost t4. Accordingly, defrosting may be performed stably using the RF signal.

Meanwhile, the main controller 310 according to an embodiment of the present disclosure may operate the fan after stopping the operation of the RF output device 190 during the cooling section after defrost t5. Accordingly, a cooling operation may be performed smoothly during the cooling section, and power consumption of the refrigerator 100 may be reduced.

Meanwhile, the main controller 310 according to an embodiment of the present disclosure may control the second idle section after defrost t6 to perform after the fan is operated, and may control the second cooling section after defrost t7 to perform after the second idle section after defrost t6, and may continuously operate the fan during the second idle section after defrost t6 and the second cooling section after defrost t7. Accordingly, defrosting may be performed smoothly during the cooling section, and power consumption of the refrigerator 100 may be reduced.

Meanwhile, while operating again the RF output device 190 during the third idle section after defrost t8 following the second cooling section after defrost t7, the main controller 310 according to an embodiment of the present disclosure may turn off the compressor 112. Accordingly, defrosting may be performed smoothly using the RF signal, and power consumption of the refrigerator 100 may be reduced.

Meanwhile, the main controller 310 according to an embodiment of the present disclosure may continuously operate the fan during the third idle section after defrost t8. Accordingly, cold air may be supplied continuously into the refrigerator 100.

Meanwhile, the main controller 310 according to an embodiment of the present disclosure may control power of the RF signal, output from the RF output device 190 during the third idle section after defrost t8, to be smaller than power of the RF signal during the defrost section t3. Accordingly, power consumption may be reduced while performing defrosting using the RF signal.

Meanwhile, the main controller 310 according to an embodiment of the present disclosure may turn off the compressor 112 while operating again the RF output device 190 during a portion of the second cooling section after defrost t7. Accordingly, power consumption may be reduced while performing defrosting using the RF signal.

Meanwhile, the main controller 310 according to an embodiment of the present disclosure may continuously operate the fan during a portion of the second cooling section after defrost t7. Accordingly, power consumption may be reduced while performing defrosting using the RF signal.

Meanwhile, the main controller 310 according to an embodiment of the present disclosure may control the power of the RF signal, output from the RF output device 190 during a portion of the second cooling section after defrost t7, to be smaller than power of the RF signal during the defrost section t3. Accordingly, power consumption may be reduced while performing defrosting using the RF signal.

Meanwhile, if a defrost end temperature of the freezer compartment 155 or the refrigerating compartment 157 in the RF output device 190 is greater than or equal to a first temperature, or if a defrost period of the RF output device 190 is greater than or equal to a first period, the main controller 310 according to an embodiment of the present disclosure may stop the operation of the RF output device 190. Accordingly, defrosting may be performed efficiently using the RF signal.

Figure 13B:
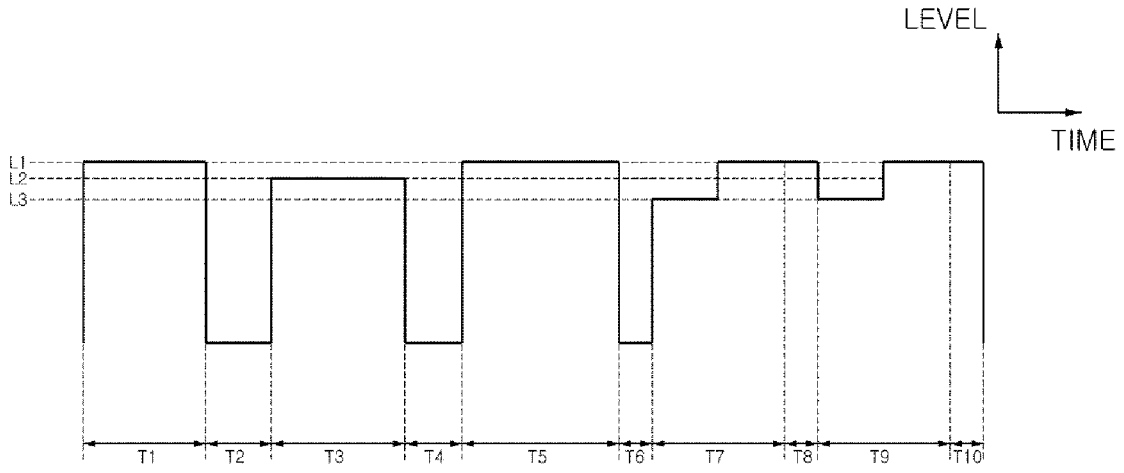

Then, FIG. 13B illustrates another example of a defrosting operation.

While similar to FIG. 13A, FIG. 13B is different in that a cooling operation is performed during the eighth section t8 and the tenth section t10 which are idle periods in FIG. 13A, and particularly, the first power L1 is consumed in the eighth section t8 and the tenth section t10. Accordingly, cooling may be performed stably after defrosting.

Figure 14:
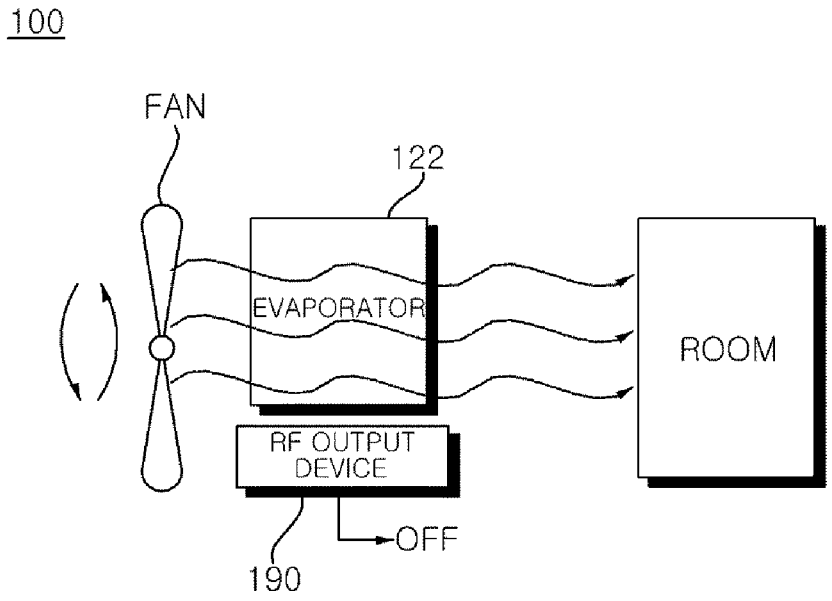

FIG. 14 illustrates an example of a positional relationship between the fan 144, the evaporator 122, the RF output device 190, and the refrigerating compartment or the freezing compartment ROOM.

Referring to the drawing, the cold air evaporated by the evaporator 122 may be supplied to the refrigerating compartment or the freezer compartment ROOM by the operation of the fan 144. In this case, the RF output device 190 may be preferably turned off. Accordingly, cold air may be supplied efficiently.

Meanwhile, the RF output device 190 operates during defrosting, and the operation of the fan 144 may be temporarily stopped, thereby allowing efficient defrosting.

Meanwhile, the RF output device 190 according to an embodiment of the present disclosure may include at least one of the following: a power detector 342 configured to detect power of the RF signal reflected from the evaporator 122; a temperature detector 320 configured to detect temperature of the evaporator 122; and a camera (not shown) configured to photograph the evaporator 122. Accordingly, defrosting may be performed efficiently using the RF signal.

For example, the RF output device 190 may operate based on the signal detected by the power detector 342.

In another example, the RF output device 190 may operate based on the detected temperature of the evaporator 122.

In yet another example, the RF output device 190 may operate when defrost is detected from an image related to the evaporator 122 which is captured by the camera (not shown).

Meanwhile, the refrigerator 100 according to an embodiment of the present disclosure may further include: a fan configured to supply cold air, generated by heat exchange in the evaporator 122, to the freezer compartment 155; and a second RF output device (not shown) disposed in a cavity of the freezer compartment 155 and configured to output a second RF signal, such that the water molecules of goods in the cavity may move, thereby delaying freezing of the goods and maintaining freshness of the goods.

Figure 15:
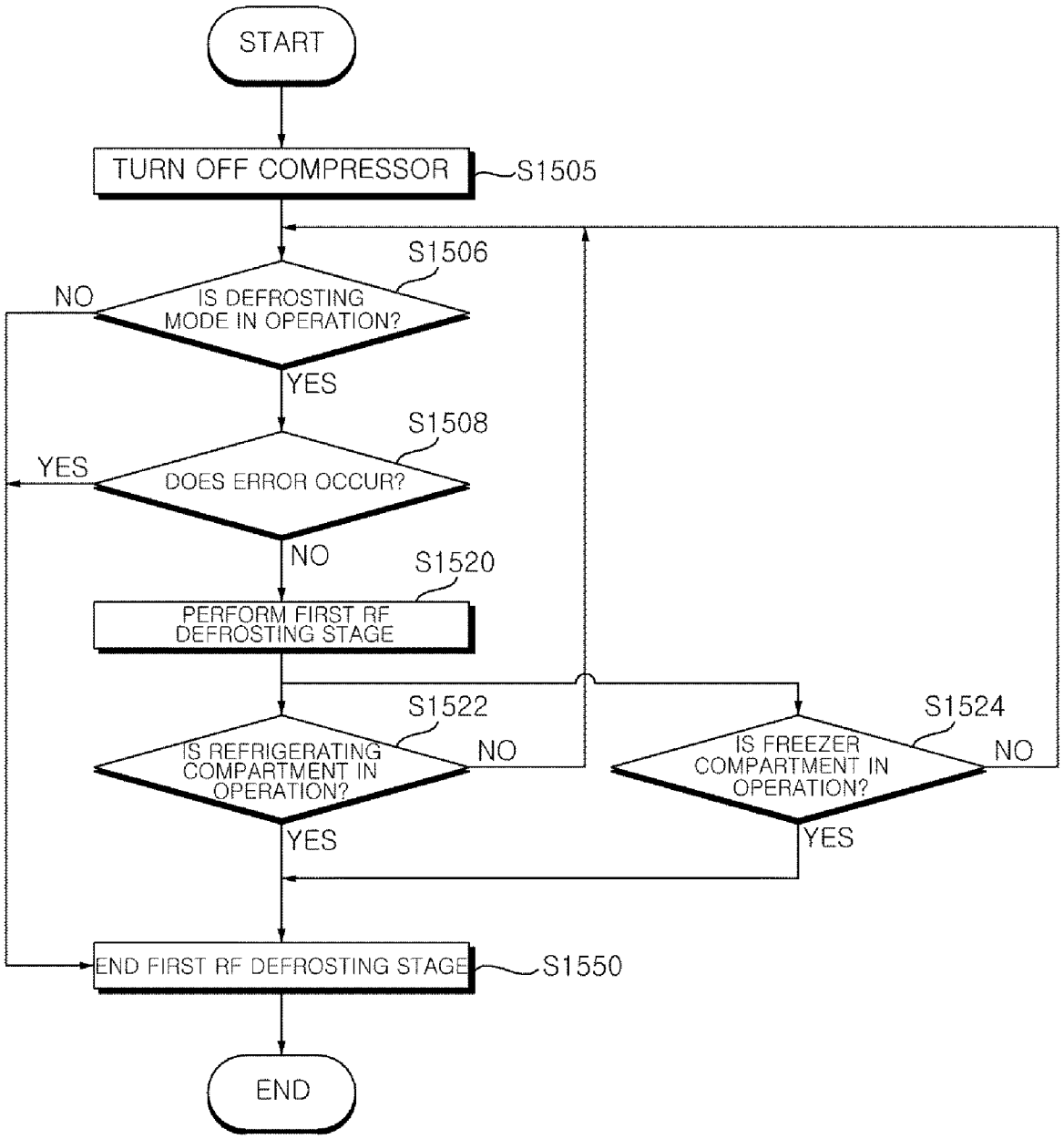
FIG. 15 is a flowchart illustrating an operating method of a refrigerator according to another embodiment of the present disclosure.

FIG. 15 is a flowchart illustrating an operating method of a refrigerator according to another embodiment of the present disclosure.

Referring to the drawing, the main controller 310 may turn off the compressor (S1505) and may perform a defrosting mode.

Meanwhile, the main controller 310 may determine whether the defrosting mode is in operation (S1506), and if an error occurs (S1508), the main controller 310 may perform a first defrosting stage (S1520).

In this case, the error may refer to a case where temperature of the refrigerating compartment or the freezer compartment is greater than or equal to a reference temperature, i.e., a case where the temperature increases.

Accordingly, the main controller 310 may reduce power of the RF signal output during the defrosting mode.

For example, the power of the RF signal in the first defrosting stage may be approximately 20 W. Accordingly, movement of water molecules occurs in frost on the evaporator 122, thereby preventing formation or further formation of frost on the evaporator 122.

Meanwhile, the power of the RF signal during defrosting before the first defrosting stage is performed may be approximately 60 W, thereby removing frost on the evaporator 122.

Then, when the refrigerating compartment operates (S1522) or the freezer compartment operates (S1524) after the first defrosting stage is performed, the main controller 310 may end the first defrosting stage (S1550). Accordingly, defrosting may be performed efficiently.

Figure 16:
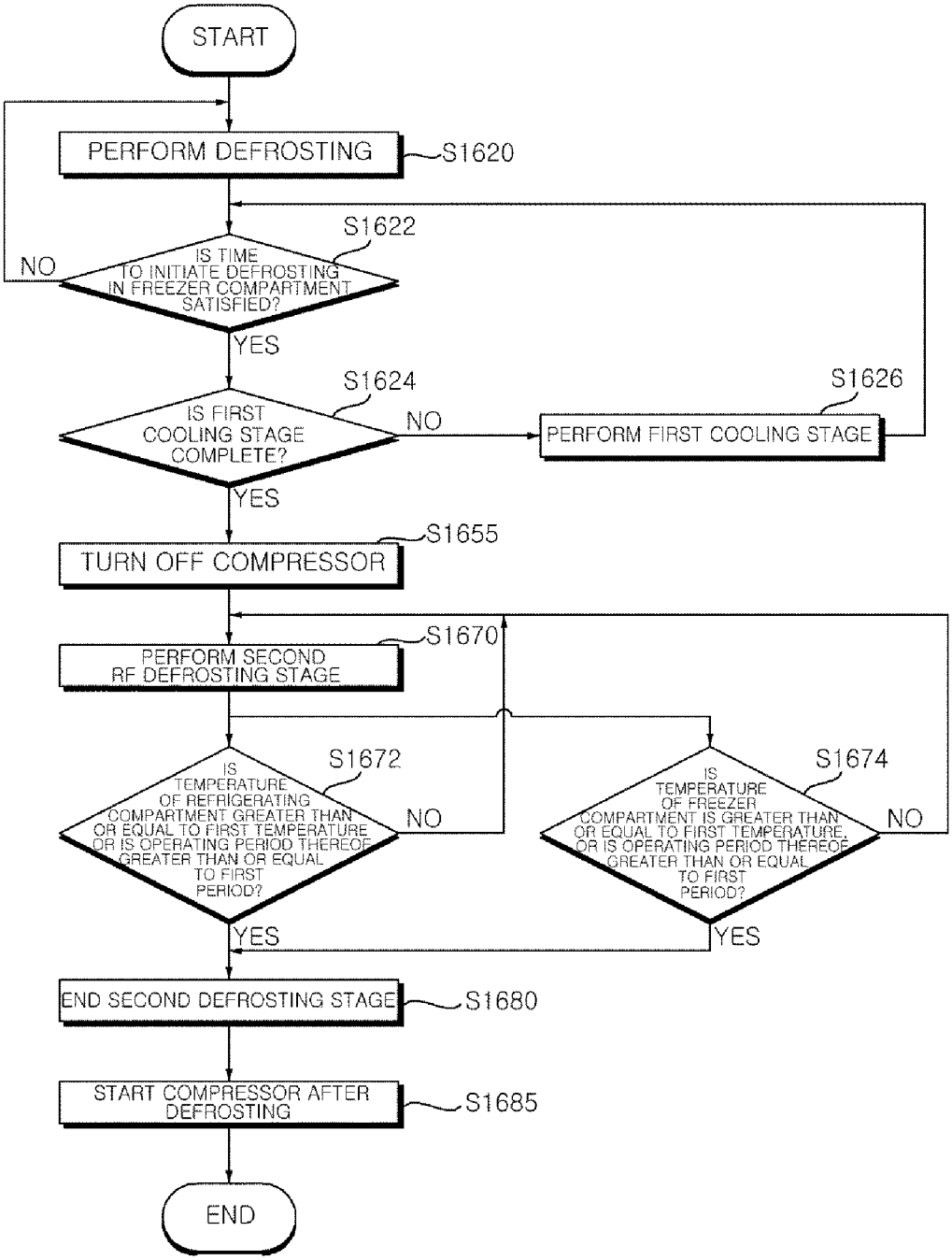
FIG. 16 is a flowchart illustrating an operating method of a refrigerator according to yet another embodiment of the present disclosure.

FIG. 16 is a flowchart illustrating an operating method of a refrigerator according to yet another embodiment of the present disclosure.

Referring to the drawing, the main controller 310 may perform defrosting (S1620).

Then, the main controller 310 determines whether a time to initiate defrosting in the freezer compartment is satisfied (S1622).

In the case where defrosting is performed sufficiently, the main controller 310 may determine whether deep cooling, corresponding to the first section t1 of FIG. 13A, is complete (S1624), and if the deep cooling is not complete, the main controller 310 may control the deep cooling, corresponding to the first section t1 of FIG. 13A, to be continuously performed (S1626).

Meanwhile, if the deep cooling is complete, the main controller 310 may turn off the compressor 9S1655), and may perform a second defrosting stage (S1670).

For example, the power of the RF signal in the second defrosting stage may be approximately 60 W. Accordingly, movement of water molecules occurs in frost on the evaporator 122, thereby preventing formation or further formation of frost on the evaporator 122.

Subsequently, the main controller 310 determines whether temperature of the refrigerating compartment is greater than or equal to a first temperature, or an operating period thereof is greater than or equal to the first period (S1672), and if so, the main controller 10 may end the second defrosting stage (S1680).

Meanwhile, the main controller 310 determines whether temperature of the freezer compartment is greater than or equal to a first temperature, or an operating period thereof is greater than or equal to a first period (S1674), and if so, the main controller 10 may end the second defrosting stage (S1680).

Next, the main controller 310 starts the compressor 122 after defrosting is performed (S1685), thereby efficiently performing the defrosting operation.

The refrigerator according to the present disclosure is not limited to the configuration and method of the embodiments described above, but the embodiments may be configured by selectively combining all or part of each embodiment so that various modifications can be made.

While the present disclosure has been particularly shown and described with reference to preferred embodiments thereof, it will be understood by those skilled in the art that the present disclosure is not limited to those exemplary embodiments and various changes in form and details may be made therein without departing from the scope and spirit of the invention as defined by the appended claims and should not be individually understood from the technical spirit or prospect of the present disclosure.

INDUSTRIAL APPLICABILITY

The present disclosure may be applied to a refrigerator capable of performing defrosting.

What is claimed is:

1. A refrigerator comprising:

a compressor configured to compress a refrigerant;

an evaporator configured to perform heat exchange using the refrigerant compressed by the compressor;

an radio frequency (RF) output device spaced apart from a part area of the evaporator, and configured to output an RF signal to the evaporator for removing frost on the evaporator; and a controller configured to control the RF output device, wherein the controller is configured to:

based on the RF signal, control the frost to phase change into a liquid by heat radiated from a plurality of metal fins of the evaporator; and after the phase change, control temperature of the phase changed liquid to increase by a water molecule movement based on the RF signal, wherein the RF output device comprises a first plate and a second plate, and the evaporator is positioned between the first plate and the second plate, wherein a height of the first plate or a height of the second plate is less than a height of the evaporator, and wherein the first plate or the second plate is positioned at an area corresponding to a lower portion of the evaporator.

2. The refrigerator of claim 1, wherein by an operation of the RF output device, temperature of the plurality of metal fins of the evaporator is higher than temperature of the phase changed liquid near the metal fins.

3. The refrigerator of claim 1, wherein as a frequency of the RF signal increases, the heat radiated from the plurality of metal fins of the evaporator increases.

4. The refrigerator of claim 1, wherein as a defrost section decreases, or as an amount of frost on the evaporator increases, or as a period of the defrost section increases, the controller is configured to increase the frequency of the RF signal.

5. The refrigerator of claim 1, wherein as a number of the plurality of metal fins of the evaporator increases, or as a distance between the plurality of metal fins of the evaporator decreases, the heat radiated from the plurality of metal fins increases.

6. The refrigerator of claim 1, wherein during at least the defrost section, the controller is configured to output the RF signal to the evaporator.

7. The refrigerator of claim 1, wherein during a portion of a cooling section before defrost, an idle section following the cooling section before defrost, the defrost section, an idle section after defrost, and a portion of a cooling section after defrost, the controller is configured to output the RF signal to the evaporator.

8. The refrigerator of claim 7, further comprising a fan configured to supply cold air generated by heat exchange in the evaporator into a freezer compartment, wherein after stopping the operation of the RF output device during the cooling section after defrost, the controller is configured to operate a fan.

9. The refrigerator of claim 8, wherein the controller controls a second idle section after defrost to perform after the fan is operated, and controls a second cooling section after defrost to perform after the second idle section after defrost, wherein during the second idle section after defrost and the second cooling section after defrost, the controller is configured to continuously operate the fan.

10. The refrigerator of claim 9, wherein during a third idle section after defrost after the second cooling section after defrost, the controller is configured to operate again the RF output device while turning off the compressor.

11. The refrigerator of claim 10, wherein the controller is configured to control power of the RF signal from the RF output device during the third idle section after defrost to be smaller than power of the RF signal during the defrost section.

12. The refrigerator of claim 1, wherein in response to a defrost end temperature of a freezer compartment or a refrigerating compartment in the RF output device being greater than or equal to a first temperature, or in response to a defrost period of the RF output device being greater than or equal to a first period, the controller is configured to stop the operation of the RF output device.

13. The refrigerator of claim 1, further comprising a defrost heater, wherein after the operation of the RF output device, the controller is configured to operate the defrost heater.

14. The refrigerator of claim 1, further comprising a frost sensor configured to detect an amount of frost on the evaporator, wherein during the operation of the RF output device, the controller is configured to change at least one of an output period and output power of the RF signal according to the amount of the deposited frost.

15. The refrigerator of claim 14, wherein the RF output device further comprises:

a heat insulating material disposed on a surface opposite to at least one evaporator of the first plate and the second plate.

16. The refrigerator of claim 1, wherein at least one of the first plate and the second plate is disposed facing at least a lower portion of the evaporator.

17. The refrigerator of claim 15, wherein the RF output device comprises at least one of:

a power detector configured to detect power of the RF signal reflected from the evaporator;

a temperature detector configured to detect temperature of the evaporator; and a camera for photographing the evaporator.

18. The refrigerator of claim 1, wherein the controller is configured to:

output an RF signal of a first power during a scan section; and output an RF signal of a second power set based on an RF signal reflected from the evaporator during the scan section.

19. A refrigerator comprising:

a compressor configured to compress a refrigerant;

an evaporator configured to perform heat exchange using the refrigerant compressed by the compressor;

an RF output device spaced apart from a part area of the evaporator, and configured to output an RF signal to the evaporator for removing frost on the evaporator; and a controller configured to control the RF output device, wherein the controller is configured to output the RF signal to the evaporator during at least a defrost section, wherein during an operation of the RF output device, temperature of a plurality of metal fins of the evaporator is higher than temperature of the frost formed on the metal fins, wherein the RF output device comprises a first plate and a second plate, and the evaporator is positioned between the first plate and the second plate, wherein a height of the first plate or a height of the second plate is less than a height of the evaporator, and wherein the first plate or the second plate is positioned at area corresponding to the lower portion of the evaporator.

20. A refrigerator comprising:

a compressor configured to compress a refrigerant;

an evaporator configured to perform heat exchange using the refrigerant compressed by the compressor;

an RF output device spaced apart from a part area of the evaporator, and configured to output an RF signal to the evaporator; and a controller configured to control the RF output device, wherein the controller is configured to, by outputting the RF signal, perform a first period in which temperature of a liquid near the evaporator decreases, and a second period in which the temperature of the liquid increases after the first period and is maintained within a predetermined range, wherein during an operation of the RF output device, temperature of a plurality of metal fins of the evaporator is higher than temperature of other regions of the evaporator, wherein the RF output device comprises a first plate and a second plate, and the evaporator is positioned between the first plate and the second plate, wherein a height of the first plate or a height of the second plate is less than a height of the evaporator, and wherein the first plate or the second plate is positioned at area corresponding to the lower portion of the evaporator.

* * * * *